US007056651B1

(12) United States Patent
Simpson et al.

(10) Patent No.: US 7,056,651 B1
(45) Date of Patent: Jun. 6, 2006

(54) CONDUCTIVE UNDERLAYERS FOR AQUEOUS-BASED THERMALLY DEVELOPABLE MATERIALS

(75) Inventors: Sharon M. Simpson, Lake Elmo, MN (US); Jon A. Hammerschmidt, Rochester, NY (US); Kumars Sakizadeh, Woodbury, MN (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 11/108,533

(22) Filed: Apr. 18, 2005

(51) Int. Cl.
*G03C 1/498* (2006.01)
*G03C 1/85* (2006.01)
*G03C 1/89* (2006.01)

(52) U.S. Cl. ..... 430/353; 430/527; 430/530; 430/618; 430/619

(58) Field of Classification Search ..... 430/353, 430/527, 530, 618, 619
See application file for complete search history.

(56) References Cited

U.S. PATENT DOCUMENTS

| | | | | |
|---|---|---|---|---|
| 5,028,580 | A | 7/1991 | Shimomura et al. | |
| 5,310,640 | A | 5/1994 | Markin et al. | |
| 5,340,676 | A | 8/1994 | Anderson et al. | |
| 5,368,995 | A | 11/1994 | Christian et al. | |
| 5,457,013 | A | 10/1995 | Christian et al. | |
| 5,731,119 | A | 3/1998 | Eichorst et al. | |
| 5,866,287 | A * | 2/1999 | Christian et al. | 430/63 |
| 6,060,230 | A * | 5/2000 | Christian et al. | 430/530 |
| 6,225,039 | B1 | 5/2001 | Eichorst et al. | |
| 6,300,049 | B1 | 10/2001 | Eichorst et al. | |
| 6,355,405 | B1 | 3/2002 | Ludemann et al. | |
| 6,464,413 | B1 | 10/2002 | Oyamada | |
| 6,576,410 | B1 | 6/2003 | Zou et al. | |
| 6,641,989 | B1 | 11/2003 | Sasaki et al. | |
| 6,689,546 | B1 | 2/2004 | LaBelle et al. | |

FOREIGN PATENT DOCUMENTS

| | | |
|---|---|---|
| EP | 0 678 776 B1 | 9/2001 |
| GB | 1 426 141 | 2/1976 |
| JP 7[1995]- | 29516 | 11/1995 |

OTHER PUBLICATIONS

U.S. Appl. No. 11/000,115, filed Nov. 30, 2004, titled *Thermally Developable Materials Having Improved Backside Layers*, by Ludemann et al.
U.S. Appl. No. 10/978,205, filed Nov. 30, 2004, titled *Thermally Developable Materials With Improved Conductive Layer*, by Ludemann et al.
U.S. Appl. No. 10/930,438, filed Nov. 30, 2004, titled *Improved Antistatic Properties For Thermally Developable Materials*, by Ludemann et al.
U.S. Appl. No. 10/920,428, filed Nov. 30, 2004, titled *Thermally Developable Materials With Backside Conductive Layer*, by Ludemann et al.

* cited by examiner

*Primary Examiner*—Richard L. Schilling
(74) *Attorney, Agent, or Firm*—J. Lanny Tucker; Louis M. Leichter

(57) ABSTRACT

Thermally developable materials for thermography or photothermography have imaging layers on one or both sides of the support. Buried conductive underlayers are disposed under these imaging layers on one or both sides of the support, and these conductive underlayers include conductive metal oxide(s) and optionally a smectite clay or lithium salt.

21 Claims, No Drawings

CONDUCTIVE UNDERLAYERS FOR AQUEOUS-BASED THERMALLY DEVELOPABLE MATERIALS

FIELD OF THE INVENTION

This invention relates to improved aqueous-based thermally developable materials such as thermographic and photothermographic materials having improved conductive underlayers and to methods of imaging these materials.

BACKGROUND OF THE INVENTION

Silver-containing thermographic and photothermographic imaging materials (that is, thermally developable imaging materials) that are imaged and/or developed using heat and without liquid processing have been known in the art for many years.

Silver-containing thermographic imaging materials are non-photosensitive materials that are used in a recording process wherein images are generated by the use of thermal energy. These materials generally comprise a support having disposed thereon (a) a relatively or completely non-photosensitive source of reducible silver ions, (b) a reducing composition (usually including a developer) for the reducible silver ions, and (c) a suitable hydrophilic or hydrophobic binder.

In a typical thermographic construction, the image-forming layers are based on silver salts of long chain fatty acids. Typically, the preferred non-photosensitive reducible silver source is a silver salt of a long chain aliphatic carboxylic acid having from 10 to 30 carbon atoms. The silver salt of behenic acid or mixtures of acids of similar molecular weight are generally used. At elevated temperatures, the silver of the silver carboxylate is reduced by a reducing agent for silver ion such as methyl gallate, hydroquinone, substituted-hydroquinones, hindered phenols, catechols, pyrogallol, ascorbic acid, and ascorbic acid derivatives, whereby an image of elemental silver is formed. Some thermographic constructions are imaged by contacting them with the thermal head of a thermographic recording apparatus such as a thermal printer or thermal facsimile. In such constructions, an anti-stick layer is coated on top of the imaging layer to prevent sticking of the thermographic construction to the thermal head of the apparatus utilized. The resulting thermographic construction is then heated to an elevated temperature, typically in the range of from about 60 to about 225° C., resulting in the formation of an image.

Silver-containing photothermographic imaging materials (that is, photosensitive thermally developable imaging materials) that are imaged with actinic radiation and then developed using heat and without liquid processing have been known in the art for many years. Such materials are used in a recording process wherein an image is formed by imagewise exposure of the photothermographic material to specific electromagnetic radiation (for example, X-radiation, or ultraviolet, visible, or infrared radiation) and developed by the use of thermal energy. These materials, also known as "dry silver" materials, generally comprise a support having coated thereon: (a) a photocatalyst (that is, a photosensitive compound such as silver halide) that upon such exposure provides a latent image in exposed grains that are capable of acting as a catalyst for the subsequent formation of a silver image in a development step, (b) a relatively or completely non-photosensitive source of reducible silver ions, (c) a reducing composition (usually including a developer) for the reducible silver ions, and (d) a hydrophilic or hydrophobic binder. The latent image is then developed by application of thermal energy.

In photothermographic materials, exposure of the photographic silver halide to light produces small clusters containing silver atoms $(Ag^0)_n$. The imagewise distribution of these clusters, known in the art as a latent image, is generally not visible by ordinary means. Thus, the photosensitive material must be further developed to produce a visible image. This is accomplished by the reduction of silver ions that are in catalytic proximity to silver halide grains bearing the silver-containing clusters of the latent image. This produces a black-and-white image. The non-photosensitive silver source is catalytically reduced to form the visible black-and-white negative image while much of the silver halide, generally, remains as silver halide and is not reduced.

In photothermographic materials, the reducing agent for the reducible silver ions, often referred to as a "developer," may be any compound that, in the presence of the latent image, can reduce silver ion to metallic silver and is preferably of relatively low activity until it is heated to a temperature sufficient to cause the reaction. A wide variety of classes of compounds have been disclosed in the literature that function as developers for photothermographic materials. At elevated temperatures, the reducible silver ions are reduced by the reducing agent. This reaction occurs preferentially in the regions surrounding the latent image. This reaction produces a negative image of metallic silver having a color that ranges from yellow to deep black depending upon the presence of toning agents and other components in the photothermographic imaging layer(s).

Differences Between Photothermography and Photography

The imaging arts have long recognized that the field of photothermography is clearly distinct from that of photography. Photothermographic materials differ significantly from conventional silver halide photographic materials that require processing with aqueous processing solutions.

In photothermographic imaging materials, a visible image is created in the absence of processing solvent by heat as a result of the reaction of a developer incorporated within the material. Heating at 50° C. or more is essential for this dry development. In contrast, conventional photographic imaging materials require processing in aqueous processing baths at more moderate temperatures (from 30° C. to 50° C.) to provide a visible image.

In photothermographic materials, only a small amount of silver halide is used to capture light and a non-photosensitive source of reducible silver ions (for example, a silver carboxylate or a silver benzotriazole) is used to generate the visible image using thermal development. Thus, the imaged photosensitive silver halide serves as a catalyst for the physical development process involving the non-photosensitive source of reducible silver ions and the incorporated reducing agent. In contrast, conventional wet-processed, black-and-white photographic materials use only one form of silver (that is, silver halide) that, upon chemical development, is itself at least partially converted into the silver image, or that upon physical development requires addition of an external silver source (or other reducible metal ions that form black images upon reduction to the corresponding metal). Thus, photothermographic materials require an amount of silver halide per unit area that is only a fraction of that used in conventional wet-processed photographic materials.

In photothermographic materials, all of the "chemistry" for imaging is incorporated within the material itself. For example, such materials include a developer (that is, a reducing agent for the reducible silver ions) while conventional photographic materials usually do not. The incorporation of the developer into photothermographic materials can lead to increased formation of various types of "fog" or other undesirable sensitometric side effects. Therefore, much effort has gone into the preparation and manufacture of photothermographic materials to minimize these problems.

Moreover, in photothermographic materials, the unexposed silver halide generally remains intact after development and the material must be stabilized against further imaging and development. In contrast, silver halide is removed from conventional photographic materials after solution development to prevent further imaging (that is in the aqueous fixing step).

Because photothermographic materials require dry thermal processing, they present distinctly different problems and require different materials in manufacture and use, compared to conventional, wet-processed silver halide photographic materials. Additives that have one effect in conventional silver halide photographic materials may behave quite differently when incorporated in photothermographic materials where the underlying chemistry is significantly more complex. The incorporation of such additives as, for example, stabilizers, antifoggants, speed enhancers, supersensitizers, and spectral and chemical sensitizers in conventional photographic materials is not predictive of whether such additives will prove beneficial or detrimental in photothermographic materials. For example, it is not uncommon for a photographic antifoggant useful in conventional photographic materials to cause various types of fog when incorporated into photothermographic materials, or for supersensitizers that are effective in photographic materials to be inactive in photothermographic materials.

These and other distinctions between photothermographic and photographic materials are described in *Unconventional Imaging Processes*, E. Brinckman et al. (Eds.), The Focal Press, London and New York, 1978, pp. 74–75, in D. H. Klosterboer, *Imaging Processes and Materials*, (*Neblette's Eighth Edition*), J. Sturge, V. Walworth, and A. Shepp, Eds., Van Nostrand-Reinhold, New York, 1989, Chapter 9, pp. 279–291, in Zou et al., *J. Imaging Sci. Technol*. 1996, 40, pp. 94–103, and in M. R. V. Sahyun, *J. Imaging Sci. Technol*. 1998,42,23.

Problem to be Solved

Many of the chemicals used to make supports or supported layers in thermally developable materials have electrically insulating properties, and electrostatic charges frequently build up on the materials during manufacture, packaging, and use. The accumulated charges can cause various problems. For example, in photothermographic materials containing photosensitive silver halides, accumulated electrostatic charge can generate light to which the silver halides are sensitive. This may result in imaging defects that are a particular problem where the images are used for medical diagnosis.

Build-up of electrostatic charge can also cause sheets of thermally processable materials to stick together causing misfeeds and jamming within processing equipment. Additionally, accumulated electrostatic charge can attract dust or other particulate matter to the materials, thereby requiring more cleaning to insure rapid transport through the processing equipment and quality imaging.

Build-up of electrostatic charge also makes handling of developed sheets of imaged material more difficult. For example, radiologists desire a static free sheet for viewing on light boxes. This problem can be particularly severe when reviewing an imaged film that has been stored for a long period of time because many antistatic materials loose their effectiveness over time.

In general, electrostatic charge is related to surface resistivity (measured in ohm/sq) and charge level. While electrostatic charge control agents (or antistatic agents) can be included in any layer of an imaging material, the accumulation of electrostatic charge can be prevented by reducing the surface resistivity or by lowering the charge level. These results can usually be achieved by including charge control agents in surface layers such as protective overcoats. In thermally processable materials, charge control agents may be used in backing layers that are on the opposite side of the support as the imaging layers. Another approach taken to reduce surface resistivity is to include a "buried" conductive layer incorporating conductive particles.

A wide variety of charge control agents, both inorganic and organic, have been devised and used for electrostatic charge control and numerous publications describe such agents. Metal oxides, including metal antimonates, are described in conductive layers in U.S. Pat. No. 5,340,676 (Anderson et al), U.S. Pat. No. 5,310,640 (Markin et al.), U.S. Pat. No. 5,368,995 (Christian et al.), U.S. Pat. No. 5,457,013 (Christian et al.), U.S. Pat. No. 5,731,119 (Eichorst et al.), U.S. Pat. No. 6,464,413 (Oyamada), and U.S. Pat. No. 6,641,989 (Sasaki et al.), and EP 0 678 776A1 (Melpolder et al.).

U.S. Pat. No. 6,355,405 (Ludemann et al.) describes thermally developable materials that include very thin adhesion-promoting layers on either side of the support. These adhesion-promoting layers are also known as "carrier" layers.

U.S. Pat. No. 6,689,546 (LaBelle et al.) describes thermally developable materials that contain a backside conductive layer comprising non-acicular metal antimonate nanoparticles (approximately 20 nm in size) in the amount of from about 40 to about 55% (based on total dry weight).

Conductive layers with a high metal antimonate to binder ratio useful in hydrophobic formulations for thermally developable materials are described for backside (non-imaging side) layers in copending and commonly assigned U.S. Ser. No. 10/930,428 (filed Aug. 31, 2004 by Ludemann, LaBelle, Koestner, Hefley, Bhave, Geisler, and Philip), Ser. No. 10/930,438 (filed Aug. 31, 2004 by Ludemann, LaBelle, Philip, Koestener, and Bhave), and Ser. No. 10/978,205 (filed Oct. 29, 2004 by Ludemann, LaBelle, Koestener, and Chen).

Smectite clays modified by quaternary ammonium compounds (also know as ammonium salts) have been used in backside antistatic layers containing conductive metal particles as described in copending and commonly assigned U.S. Ser. No. 11/000,115 (filed Nov. 30, 2004 by Ludemann et al.).

Duplitized photothermographic materials have been described in U.S. Pat. No. 6,576,410 (Zou et al.). Those materials are said to have antistatic layers containing a variety of conductive particles including metal antimonate particles and/or fluoro-chemicals as conductive agents. The location of the antistatic layers is generalized and no demonstration of their use is given.

A challenge in photothermographic materials is the need to improve their stability at ambient temperature and relative humidity during storage prior to use. This stability is referred to as "natural Age Keeping" (NAK) or as "Raw Stock Keeping" (RSK). It is desirable that photothermographic materials be capable of maintaining imaging properties, including photospeed and Dmax, while minimizing any increase in Dmin during storage. Natural Age Keeping is a particular problem for photothermographic materials compared to conventional silver halide photographic films because, as noted above, all the components needed for development and image formation in photothermographic systems are incorporated into the imaging element, in intimate proximity, prior to development. Thus, there are a greater number of potentially reactive components that can prematurely react during storage. It is more particularly a problem for aqueous-based photothermographic materials that are prepared using aqueous formulations that leave residual water in the layers.

Lithium salts have been included in photothermographic materials for a number of purposes. JP Kokai 2005-003789 (Goto) describes the use of fluorinated lithium salts surfactants. GB 1,426,141 (Ikenoue et al.) describes the use of lithium laurate as an antifoggant and silver laurate as a source of reducible silver ions. Lithium stearate has been used in a similar fashion (see JP Kokai 51 047419 (Ikenoue et al.). Lithium bromide has been used to form silver halide in situ. However, nothing has been found in the literature to suggest that lithium salts would improve Natural Age Keeping.

There is a continuing need in the industry to find more efficient and less costly ways to reduce electrostatic charge, particularly in layers "buried" beneath photothermographic emulsion layers on both sides of the support. There also remains a need to improve Natural Age Keeping without a loss in other desired sensitometric properties such as Dmax and photospeed.

SUMMARY OF THE INVENTION

The noted problems are solved with a black-and-white aqueous-based thermally developable material comprising a support and having thereon at least one thermally developable imaging layer comprising a first hydrophilic polymer binder or a water-dispersible polymer latex binder and in reactive association a non-photosensitive source of reducible silver ions, and a reducing agent for the reducible silver ions, and having disposed on the support between the support and the thermally developable imaging layer, a non-imaging conductive underlayer comprising one or more second hydrophilic polymers, a conductive metal oxide, and a smectite clay.

In additional embodiments, a black-and-white photothermographic material comprises a support having on a frontside thereof, a) one or more frontside photothermographic imaging layers comprising a hydrophilic polymer binder or a water-dispersible polymer latex binder, and in reactive association, a preformed photosensitive silver halide, a non-photosensitive source of reducible silver ions that is predominantly a silver salt of a nitrogen-containing heterocyclic compound containing an imino group, and a reducing agent for the non-photosensitive source reducible silver ions, b) the material comprising on the backside of the support, one or more backside photothermographic imaging layers having the same or different composition as the photothermographic imaging layers, and c) optionally, an outermost protective layer disposed over the one or more photothermographic imaging layers on either or both sides of the support, the material also comprising on both sides of the support, the same or different non-photosensitive conductive underlayer disposed between the support and the photothermographic layers, the same or different non-photosensitive conductive underlayer comprising a conductive metal oxide dispersed within a second hydrophilic polymer binder or water-dispersible polymer latex, the conductive metal particles comprising particles or clusters of non-acicular zinc antimonate.

This invention also provides a method of forming a visible image comprising:

(A) imagewise exposing the photothermographic material of this invention to form a latent image, (B) simultaneously or sequentially, heating the exposed photothermographic material to develop the latent image into a visible image.

In alternative methods of this invention, a method of forming a visible image comprises:

(A') thermal imaging of the thermally developable material of this invention that is a thermographic material.

An imaging assembly can comprise the photothermographic material of this invention that is arranged in association with one or more phosphor intensifying screens.

The images obtained using the present invention can be used for a medical diagnosis as well as other purposes.

The present invention provides a means for improving the conductivity of aqueous-based thermally developable materials. Where the materials are duplitized, this has been done by a using buried conductive layer under thermally developable imaging layers on one or both sides of the support. Where the materials have imaging layers on one side only, the conductive underlayer further contains a smectite clay. The conductive underlayers (or "buried" layers) are generally thin compared to other coated layers, providing lower overall manufacturing cost. While it is contemplated that any conductive metal particles can be used in the buried conductive layer, the advantages are best seen with the use of metal antimonate particles, with or without a smectite clay.

DETAILED DESCRIPTION OF THE INVENTION

The thermally developable materials described herein are both thermographic and photothermographic materials. While the following discussion will often be directed primarily to the preferred aqueous-coated photothermographic embodiments, it would be readily understood by one skilled in the art that aqueous-based thermographic materials can be similarly constructed and used to provide black-and-white or color images using appropriate imaging chemistry and particularly non-photosensitive organic silver salts, reducing agents, toners, binders, and other components known to a skilled artisan.

The thermally developable materials can be used in black-and-white photothermography and in electronically generated black-and-white hardcopy recording. They can be used in microfilm applications, in radiographic imaging (for example digital medical imaging), X-ray radiography, and in industrial radiography. Furthermore, in some embodiments, the absorbance of these materials between 350 and 450 nm is desirably low (less than 0.5), to permit their use in the graphic arts area (for example, imagesetting and phototypesetting), in the manufacture of printing plates, in contact printing, in duplicating ("duping"), and in proofing.

The thermally developable materials are particularly useful for imaging of human or animal subjects in response to visible, X-radiation, or infrared radiation for use in a medical diagnosis. Such applications include, but are not limited to, thoracic imaging, mammography, dental imaging, orthopedic imaging, general medical radiography, therapeutic radiography, veterinary radiography, and autoradiography. When used with X-radiation, the photothermographic materials may be used in combination with one or more phosphor intensifying screens, with phosphors incorporated within the photothermographic emulsion, or with combinations thereof. Such materials are particularly useful for dental radiography when they are directly imaged by X-radiation. The materials are also useful for non-medical uses of X-radiation such as X-ray lithography and industrial radiography. In these and other imaging applications, it is often particularly desirable that the photothermographic materials be "double-sided."

The photothermographic materials can be made sensitive to radiation of any suitable wavelength. Thus, in some embodiments, the materials are sensitive at ultraviolet, visible, near infrared, or infrared wavelengths, of the electromagnetic spectrum. In these embodiments, the materials are preferably sensitive to radiation greater than 100 nm, such as from about 100 nm to about 1400 nm, normally from about 300 to about 850 nm, (preferably from about 300 to about 600 nm, more preferably from about 300 to about 450 nm, even more preferably from a wavelength of from about 360 to 420 nm, and most preferably from about 380 to about 420 nm). In other embodiments they are sensitive to X-radiation. Increased sensitivity to X-radiation can be imparted through the use of phosphors.

In some embodiments of the photothermographic materials, the components needed for imaging can be in one or more imaging or emulsion layers on one side ("frontside") of the support. The layer(s) that contain the photosensitive photocatalyst (such as a photosensitive silver halide) for photothermographic materials or the non-photosensitive source of reducible silver ions, or both, are referred to herein as the emulsion layer(s). In photothermographic materials, the photocatalyst and non-photosensitive source of reducible silver ions are in catalytic proximity and preferably are in the same emulsion layer.

Where the photothermographic materials contain imaging layers on one side of the support only, various non-imaging layers can also be disposed on the "backside" (non-emulsion or non-imaging side) of the materials, including, additional conductive or antistatic layers, antihalation layer(s), protective layers, and transport enabling layers.

In such instances, various non-imaging layers can also be disposed on the "frontside" or imaging or emulsion side of the support, including protective overcoat layers, primer layers, interlayers, opacifying layers, antistatic layers, antihalation layers, acutance layers, auxiliary layers, and other layers readily apparent to one skilled in the art.

For preferred embodiments, the photothermographic materials are "double-sided" or "duplitized" and have the same or different emulsion coatings (or photothermographic imaging layers) on both sides of the support. In addition to the buried conductive layers, such constructions can also include one or more protective overcoat layers, primer layers, interlayers, acutance layers, antihalation layers, auxiliary layers, and other layers readily apparent to one skilled in the art on either or both sides of support. Preferably, such photothermographic materials have essentially the same layers on each side of the support.

Similarly, in the thermographic materials of this invention, the components needed for imaging can be in one or more imaging layers. The layer(s) that contain the non-photosensitive source of reducible silver ions are referred to herein as thermographic emulsion layer(s).

When the thermally developable materials are heat-developed as described below in a substantially water-free condition after, or simultaneously with, imagewise exposure, a silver image (preferably a black-and-white silver image) is obtained.

Definitions

As used herein:

In the descriptions of the photothermographic materials, "a" or "an" component refers to "at least one" of that component (for example, the conductive metal particles described herein).

The term "black-and-white" refers to an image formed by silver metal.

Unless otherwise indicated, the terms "photothermographic materials", "thermographic materials", "thermally developable materials", and "imaging assemblies" are used herein in reference to embodiments of the present invention.

Heating in a substantially water-free condition as used herein, means heating at a temperature of from about 50° C. to about 250° C. with little more than ambient water vapor present. The term "substantially water-free condition" means that the reaction system is approximately in equilibrium with water in the air and water for inducing or promoting the reaction is not particularly or positively supplied from the exterior to the material. Such a condition is described in T. H. James, *The Theory of the Photographic Process*, Fourth Edition, Eastman Kodak Company, Rochester, N.Y., 1977, p. 374.

"Aqueous based" means that the solvent in which the imaging layer and the conductive layer are prepared and coated is predominantly (greater than 90%) water.

"Photothermographic material(s)" means a dry processable integral element comprising at least one photothermographic emulsion layer or a photothermographic set of emulsion layers (wherein the photosensitive silver halide and the source of reducible silver ions, are in one layer and the other essential components or desirable additives are distributed, as desired, in the same layer or in an adjacent coated layer) that provides a black-and-white silver image. These materials also include multilayer constructions in which one or more imaging components are in different layers, but are in "reactive association." For example, one layer can include the non-photosensitive source of reducible silver ions and another layer can include the reducing agent and/or photosensitive silver halide. By "integral," we mean that all imaging chemistry required for imaging is in the material without diffusion of imaging chemistry or reaction products (such as a dye) from or to another element (such as a receiver element).

"Thermographic materials" are similarly defined except that no photosensitive silver halide photocatalyst is purposely added or created.

When used in photothermography, the term, "imagewise exposing" or "imagewise exposure" means that the material is imaged using any exposure means that provides a latent image using electromagnetic radiation. This includes, for example, by analog exposure where an image is formed by projection onto the photosensitive material as well as by digital exposure where the image is formed one pixel at a time such as by modulation of scanning laser radiation.

When used in thermography, the term, "imagewise exposing" or "imagewise exposure" means that the material is imaged using any means that provides an image using heat. This includes, for example, by analog exposure where an image is formed by differential contact heating through a mask using a thermal blanket or infrared heat source, as well as by digital exposure where the image is formed one pixel at a time such as by modulation of thermal print-heads or by thermal heating using scanning laser radiation.

"Catalytic proximity" or "reactive association" means that the materials are in the same layer or in adjacent layers so that they readily come into contact with each other during thermal imaging and development.

"Emulsion layer," "imaging layer," "photothermographic imaging layer," or "thermographic imaging layer" means a layer of a thermographic or photothermographic material that contains the photosensitive silver halide (when used) and/or non-photosensitive source of reducible silver ions or a reducing composition. Such layers can also contain additional components or desireable additives. In single-sided materials, these layers are usually on what is known as the "frontside" of the support.

"Photocatalyst" means a photosensitive compound such as silver halide that, upon exposure to radiation, provides a compound that is capable of acting as a catalyst for the subsequent development of the image-forming material.

"Simultaneous coating" or "wet-on-wet" coating means that when multiple layers are coated, subsequent layers are coated onto the initially coated layer before the initially coated layer is dry.

The terms "double-sided" and "duplitized" are used to define photothermographic materials having one or more of the same or different photothermographic emulsion layers disposed on both sides (front and back) of the support. In double-sided materials the emulsion layers can be of the same or different chemical composition, thickness, or sensitometric properties.

In addition, "frontside" also generally means the side of a photothermographic material that is first exposed to imaging radiation, and "backside" generally refers to the opposite side of the photothermographic material.

"Ultraviolet region of the spectrum" refers to that region of the spectrum less than or equal to 400 nm, and preferably from about 100 nm to about 400 nm, although parts of these ranges may be visible to the naked human eye. More preferably, the ultraviolet region of the spectrum is the region of from about 190 nm to about 400 nm. The near ultraviolet region of the spectrum refers to that region of from about 300 to about 400 nm.

"Visible region of the spectrum" refers to that region of the spectrum of from about 400 nm to about 700 nm.

"Short wavelength visible region of the spectrum" refers to that region of the spectrum of from about 400 nm to about 450 nm.

"Blue region of the spectrum" refers to that region of the spectrum of from about 400 nm to about 500 nm.

"Green region of the spectrum" refers to that region of the spectrum of from about 500 nm to about 600 nm.

"Red region of the spectrum" refers to that region of the spectrum of from about 600 nm to about 700 nm.

"Infrared region of the spectrum" refers to that region of the spectrum of from about 700 nm to about 1400 nm.

"Non-photosensitive" means not intentionally light sensitive.

"Transparent" means capable of transmitting visible light or imaging radiation without appreciable scattering or absorption.

The sensitometric terms "photospeed," "speed," or "photographic speed" (also known as sensitivity), absorbance, contrast, Dmin, and Dmax have conventional definitions known in the imaging arts. In photothermographic materials, Dmin is considered herein as image density achieved when the photothermographic material is thermally developed without prior exposure to radiation. It is the average of eight lowest density values on the exposed side of the fiducial mark.

In photothermographic materials, the term Dmin (lower case) is considered herein as image density achieved when the photothermographic material is thermally developed without prior exposure to radiation. The term Dmax (lower case) is the maximum image density achieved in the imaged area of a particular sample after imaging and development. In thermographic materials, Dmin is considered herein as the image density in the areas with the minimum application of heat by the thermal print-head. In thermographic materials, the term Dmax is the maximum image density achieved when the thermographic material is thermally imaged with a given amount of thermal energy.

In both photothermographic and thermographic materials, the term DMIN (upper case) is the density of the non-imaged material. In photothermographic materials, the term DMAX (upper case) is the maximum image density achievable when the photothermographic material is exposed and then thermally developed. In thermographic materials, the term DMAX is the maximum image density achievable when the thermographic material is thermally developed. DMAX is also known as "Saturation Density."

In photothermographic materials, the term Dmax is the maximum image density achieved when the photothermographic material is exposed to a particular radiation source and a given amount of radiation energy and then thermally developed.

The terms "density," "optical density (OD)," and "image density" refer to the sensitometric term absorbance.

Speed-2 is Log1/E+4 corresponding to the density value of 1.0 above Dmin where E is the exposure in ergs/cm$^2$.

"Natural Age Keeping" (NAK), also known as "Raw Stock Keeping" (RSK) or "Shelf-Life Stability" is the stability of the non-imaged film when stored in the dark for a period of time under a given set of temperature and relative humidity conditions.

"Aspect ratio" refers to the ratio of particle or grain "ECD" to particle or grain thickness wherein ECD (equivalent circular diameter) refers to the diameter of a circle having the same projected area as the particle or grain.

The phrase "silver salt" or "organic silver salt" refers to an organic molecule capable of forming a bond with a silver atom. Although the compounds so formed are technically silver coordination complexes or silver compounds they are often referred to as silver salts.

As used herein in reference to conductive layers, the terms "underlayer" and "buried" conductive layer refer to the same conductive layer.

In the compounds described herein, no particular double bond geometry (for example, cis or trans) is intended by the structures drawn unless otherwise specified. Similarly, in compounds having alternating single and double bonds and localized charges their structures are drawn as a formalism. In reality, both electron and charge delocalization exists throughout the conjugated chain.

As is well understood in this art, for the chemical compounds herein described, substitution is not only tolerated, but is often advisable and various substituents are anticipated on the compounds used in the present invention unless otherwise stated. Thus, when a compound is referred to as "having the structure" of, or as "a derivative" of, a given formula, any substitution that does not alter the bond structure of the formula or the shown atoms within that structure is included within the formula, unless such substitution is specifically excluded by language.

As a means of simplifying the discussion and recitation of certain substituent groups, the term "group" refers to chemical species that may be substituted as well as those that are not so substituted. Thus, the term "alkyl group" is intended to include not only pure hydrocarbon alkyl chains, such as methyl, ethyl, n-propyl, t-butyl, cyclohexyl, iso-octyl, and octadecyl, but also alkyl chains bearing substituents known in the art, such as hydroxy, alkoxy, phenyl, halogen atoms (F, Cl, Br, and I), cyano, nitro, amino, and carboxy. For example, alkyl group includes ether and thioether groups (for example $CH_3—CH_2—CH_2—O—CH_2—$ and $CH_3—CH_2—CH_2—S—CH_2—$), hydroxyalkyl (such as 1,2-dihydroxyethyl), haloalkyl, nitroalkyl, alkylcarboxy, carboxyalkyl, carboxamido, sulfoalkyl, and other groups readily apparent to one skilled in the art. Substituents that adversely react with other active ingredients, such as very strongly electrophilic or oxidizing substituents, would, of course, be excluded by the ordinarily skilled artisan as not being inert or harmless.

*Research Disclosure* (http://www.researchdisclosure-.com) is a publication of Kenneth Mason Publications Ltd., The Book Barn, Westbourne, Hampshire PO10 8RS, UK. It is also available from Emsworth Design Inc., 200 Park Avenue South, Room 1101, New York, N.Y. 10003.

Other aspects, advantages, and benefits of the present invention are apparent from the detailed description, examples, and claims provided in this application.

The Photocatalyst

The photothermographic materials include one or more photocatalysts in the photothermographic emulsion layer(s). Useful photocatalysts are typically photosensitive silver halides such as silver bromide, silver iodide, silver chloride, silver bromoiodide, silver chlorobromoiodide, silver chlorobromide, and others readily apparent to one skilled in the art. Mixtures of silver halides can also be used in any suitable proportion. Silver bromide and silver bromoiodide are more preferred silver halides, with the latter silver halide having up to nearly 100 mol % silver iodide (more preferably up to 40 mol %) silver iodide, based on total silver halide, and up to the saturation limit of iodide as described in U.S. Patent Application Publication 2004/0053173 (Maskasky et al.).

The shape (morphology) of the photosensitive silver halide grains used in the present need not be limited. The silver halide grains may have any crystalline habit including cubic, octahedral, tetrahedral, orthorhombic, rhombic, dodecahedral, other polyhedral, tabular, laminar, twinned, or platelet morphologies and may have epitaxial growth of crystals thereon. If desired, a mixture of these crystals can be employed. Silver halide grains having cubic and tabular morphology (or both) are preferred. More preferably, the silver halide grains are predominantly (at least 50% based on total silver halide) present as tabular grains.

The silver halide grains may have a uniform ratio of halide throughout. They may have a graded halide content, with a continuously varying ratio of, for example, silver bromide and silver iodide or they may be of the core-shell type, having a discrete core of one or more silver halides, and a discrete shell of one of more different silver halides. Core-shell silver halide grains useful in photothermographic materials and methods of preparing these materials are described for example in U.S. Pat. No. 5,382,504 (Shor et al.), incorporated herein by reference. Iridium and/or copper doped core-shell and non-core-shell grains are described in U.S. Pat. No. 5,434,043 (Zou et al.) and U.S. Pat. No. 5,939,249 (Zou), both incorporated herein by reference.

In some instances, it may be helpful to prepare the photosensitive silver halide grains in the presence of a hydroxytetraazaindene or an N-heterocyclic compound comprising at least one mercapto group as described in U.S. Pat. No. 6,413,710 (Shor et al.), that is incorporated herein by reference.

The photosensitive silver halide can be added to (or formed within) the emulsion layer(s) in any fashion as long as it is placed in catalytic proximity to the non-photosensitive source of reducible silver ions.

It is preferred that the silver halide grains be "preformed" and thus prepared by an ex-situ process, chemically and spectrally sensitized, and then be added to and physically mixed with the non-photosensitive source of reducible silver ions.

It is also possible, but less preferred, to form the source of reducible silver ions in the presence of ex-situ-prepared silver halide grains. In this process, the source of reducible silver ions is formed in the presence of the preformed silver halide grains. Precipitation of the reducible source of silver ions in the presence of silver halide provides a more intimate mixture of the two materials [see, for example U.S. Pat. No. 3,839,049 (Simons)] to provide a "preformed emulsion." This method is useful when non-tabular silver halide grains are used.

It is also possible to form some in-situ silver halide, by a process in which an inorganic halide- or an organic halogen-containing compound is added to an organic silver salt to partially convert the silver of the organic silver salt to silver halide as described in U.S. Pat. No. 3,457,075 (Morgan et al.).

In general, the non-tabular silver halide grains used in this invention can vary in average diameter of up to several micrometers (μm) and they usually have an average particle size of from about 0.01 to about 1.5 μm (preferably from about 0.03 to about 1.0 μm, and more preferably from about 0.05 to about 0.8 μm). The average size of the photosensitive silver halide grains is expressed by the average diameter if the grains are spherical, and by the average of the diameters of equivalent circles for the projected images if the grains are cubic, tabular, or other non-spherical shapes. Representative grain sizing methods are described by in *Particle Size Analysis*, ASTM Symposium on Light Microscopy, R. P. Loveland, 1955, pp. 94–122, and in C. E. K. Mees and T. H. James, *The Theory of the Photographic Process*, Third Edition, Macmillan, New York, 1966, Chapter 2.

In preferred embodiments of this invention, the silver halide grains are provided predominantly (based on at least 50 mol % silver) as tabular silver halide grains that are considered "ultrathin" and have an average thickness of at least 0.02 μm and up to and including 0.10 μm (preferably an average thickness of at least 0.03 μm and more preferably of at least 0.04 μm, and up to and including 0.08 μm and more preferably up to and including 0.07 μm).

In addition, these ultrathin tabular grains have an equivalent circular diameter (ECD) of at least 0.5 μm (preferably at least 0.75 μm, and more preferably at least 1 μm). The ECD can be up to and including 8 μm (preferably up to and including 6 μm, and more preferably up to and including 4 μm).

The aspect ratio of the useful tabular grains is at least 5:1 (preferably at least 10:1, and more preferably at least 15:1) and generally up to 50:1. The grain size of ultrathin tabular grains may be determined by any of the methods commonly employed in the art for particle size measurement, such as those described above. Ultrathin tabular grains and their method of preparation and use in photothermographic materials are described in U.S. Pat. No. 6,576,410 (Zou et al.) and U.S. Pat. No. 6,673,529 (Daubendiek et al.) that are incorporated herein by reference.

The ultrathin tabular silver halide grains can also be doped using one or more of the conventional metal dopants known for this purpose including those described in *Research Disclosure*, item 38957, September, 1996 and U.S. Pat. No. 5,503,970 (Olm et al.), incorporated herein by reference. Preferred dopants include iridium (III or IV) and ruthenium (II or III) salts. Particularly preferred silver halide grains are ultrathin tabular grains containing iridium-doped azole ligands. Such tabular grains and their method of preparation are described in U.S. Pat. No. 6,969,582 (Olm et al.) that is incorporated herein by reference.

The one or more light-sensitive silver halides used in the photothermographic materials are preferably present in an amount of from about 0.005 to about 0.5 mole (more preferably from about 0.01 to about 0.25 mole, and most preferably from about 0.03 to about 0.15 mole) per mole of non-photosensitive source of reducible silver ions.

Chemical Sensitizers

If desired, the photosensitive silver halides used in the photothermographic materials can be chemically sensitized using any useful compound that contains sulfur, tellurium, or selenium, or may comprise a compound containing gold, platinum, palladium, ruthenium, rhodium, iridium, or combinations thereof, a reducing agent such as a tin halide or a combination of any of these. The details of these materials are provided for example, in T. H. James, *The Theory of the Photographic Process*, Fourth Edition, Eastman Kodak Company, Rochester, N.Y., 1977, Chapter 5, pp. 149–169. Suitable conventional chemical sensitization procedures and compounds are also described in U.S. Pat. No. 1,623,499 (Sheppard et al.), U.S. Pat. No. 2,399,083 (Waller et al.), U.S. Pat. No. 3,297,446 (Dunn), U.S. Pat. No. 3,297,447 (McVeigh), U.S. Pat. No. 5,049,485 (Deaton), U.S. Pat. No. 5,252,455 (Deaton), U.S. Pat. No. 5,391,727 (Deaton), U.S. Pat. No. 5,691,127 (Daubendiek et al.), U.S. Pat. No. 5,759,761 (Lushington et al.), U.S. Pat. No. 5,912,111 (Lok et al.), and U.S. Pat. No. 6,296,998 (Eikenberry et al), and EP 0 915 371 A1 (Lok et al.), all incorporated herein by reference.

Certain substituted or and unsubstituted thioureas can be used as chemical sensitizers including those described in U.S. Pat. No. 4,810,626 (Burgmaier et al.), U.S. Pat. No. 6,296,998 (Eikenberry et al.), U.S. Pat. No. 6,322,961 (Lam et al.), and U.S. Pat. No. 6,368,779 (Lynch et al.), all of the which are incorporated herein by reference.

Still other useful chemical sensitizers include tellurium- and selenium-containing compounds that are described in and U.S. Pat. No. 5,158,892 (Sasaki et al.), U.S. Pat. No. 5,238,807 (Sasaki et al.), U.S. Pat. No. 5,942,384 (Arai et al.), U.S. Pat. No. 6,620,577 (Lynch et al.), and U.S. Pat. No. 6,699,647 (Lynch et al.), all of which are incorporated herein by reference.

Noble metal sensitizers for use in the present invention include gold, platinum, palladium and iridium. Gold(I or III) sensitization is particularly preferred, and described in U.S. Pat. No. 5,858,637 (Eshelman et al.) and U.S. Pat. No. 5,759,761 (Lushington et al.). Combinations of gold(III) compounds and either sulfur- or tellurium-containing compounds are useful as chemical sensitizers and are described in U.S. Pat. No. 6,423,481 (Simpson et al.). All of the above references are incorporated herein by reference.

In addition, sulfur-containing compounds can be decomposed on silver halide grains in an oxidizing environment according to the teaching in U.S. Pat. No. 5,891,615 (Winslow et al.). Examples of sulfur-containing compounds that can be used in this fashion include sulfur-containing spectral sensitizing dyes. Other useful sulfur-containing chemical sensitizing compounds that can be decomposed in an oxidized environment are the diphenylphosphine sulfide compounds described in U.S. Publication 2005/0123870. Both the above patent and patent publication are incorporated herein by reference.

The chemical sensitizers can be used in making the silver halide emulsions in conventional amounts that generally depend upon the average size of silver halide grains. Generally, the total amount is at least $10^{-10}$ mole per mole of total silver, and preferably from about $10^{-8}$ to about $10^{-2}$ mole per mole of total silver. The upper limit can vary depending upon the compound(s) used, the level of silver halide, and the average grain size and grain morphology.

Spectral Sensitizers

The photosensitive silver halides used in the photothermographic materials may be spectrally sensitized with one or more spectral sensitizing dyes that are known to enhance silver halide sensitivity to ultraviolet, visible, and/or infrared radiation of interest. Non-limiting examples of sensitizing dyes that can be employed include cyanine dyes, merocyanine dyes, complex cyanine dyes, complex merocyanine dyes, holopolar cyanine dyes, hemicyanine dyes, styryl dyes, and hemioxanol dyes. They may be added at any stage in chemical finishing of the photothermographic emulsion, but are generally added after chemical sensitization. It is particularly useful that the photosensitive silver halides be spectrally sensitized to a wavelength of from about 300 to about 850 nm, preferably from about 300 to about 600 nm, more preferably to a wavelength of from about 300 to about 450 nm, even more preferably from a wavelength of from about 360 to 420 nm, and most preferably from a wavelength of from about 380 to about 420 nm. In other embodiments, the photosensitive silver halides are spectrally sensitized to a wavelength of from about 650 to about 1150 nm. A worker skilled in the art would know which dyes would provide the desired spectral sensitivity.

Suitable sensitizing dyes such as those described in U.S. Pat. No. 3,719,495 (Lea), U.S. Pat. No. 4,396,712 (Kinoshita et al.), U.S. Pat. No. 4,439,520 (Kofron et al.), U.S. Pat. No. 4,690,883 (Kubodera et al.), U.S. Pat. No. 4,840,882 (Iwagaki et al.), U.S. Pat. No. 5,064,753 (Kohno et al.), U.S. Pat. No. 5,281,515 (Delprato et al.), U.S. Pat. No. 5,393,654 (Burrows et al), U.S. Pat. No. 5,441,866 (Miller et al.), U.S. Pat. No. 5,508,162 (Dankosh), U.S. Pat. No. 5,510,236 (Dankosh), and U.S. Pat. No. 5,541,054 (Miller et al.), and Japanese Kokai 2000-063690 (Tanaka et al.), 2000-112054 (Fukusaka et al.), 2000-273329 (Tanaka et al.), 2001-005145 (Arai), 2001-064527 (Oshiyama et al.), and 2001-154305 (Kita et al.), and *Research Disclosure*, item 308119, Section IV, December, 1989. All of these publications are incorporated herein by reference.

Teachings relating to specific combinations of spectral sensitizing dyes also provided in U.S. Pat. No. 4,581,329 (Sugimoto et al.), U.S. Pat. No. 4,582,786 (Ikeda et al.), U.S. Pat. No. 4,609,621 (Sugimoto et al.), U.S. Pat. No. 4,675,279 (Shuto et al.), U.S. Pat. No. 4,678,741 (Yamada et al.), U.S. Pat. No. 4,720,451 (Shuto et al.), U.S. Pat. No. 4,818,675 (Miyasaka et al.), U.S. Pat. No. 4,945,036 (Arai et al.), and U.S. Pat. No. 4,952,491 (Nishikawa et al.), all of which are incorporated herein by reference.

Also useful are spectral sensitizing dyes that decolorize by the action of light or heat as described in U.S. Pat. No.

4,524,128 (Edwards et al.) and Japanese Kokai 2001-109101 (Adachi), 2001-154305 (Kita et al.), and 2001-183770 (Hanyu et al.), all of which are incorporated herein by reference.

Dyes may be selected for the purpose of supersensitization to attain much higher sensitivity than the sum of sensitivities that can be achieved by using each dye alone.

An appropriate amount of spectral sensitizing dye added is generally about $10^{-10}$ to $10^{-1}$ mole, and preferably, from about $10^{-7}$ to $10^{-2}$ mole per mole of silver halide.

Non-Photosensitive Source of Reducible Silver Ions

The non-photosensitive source of reducible silver ions used in the thermally developable materials is a silver-organic compound that contains reducible silver(I) ions. Such compounds are generally silver salts of silver organic coordinating ligands that are comparatively stable to light and form a silver image when heated to 50° C. or higher in the presence of an exposed photocatalyst and a reducing agent composition.

Organic silver salts that are particularly useful in aqueous based thermally developable materials include silver salts of compounds containing an imino group. Such salts include, but are not limited to, silver salts of benzotriazole and substituted derivatives thereof (for example, silver methylbenzotriazole and silver 5-chlorobenzotriazole), silver salts of nitrogen acids selected from the group consisting of imidazole, pyrazole, urazole, 1,2,4-triazole and 1H-tetrazole, nitrogen acids or combinations thereof, as described in U.S. Pat. No. 4,220,709 (deMauriac). Also included are the silver salts of imidazole and imidazole derivatives as described in U.S. Pat. No. 4,260,677 (Winslow et al.). Both of these patents are incorporated herein by reference. A nitrogen acid as described herein is intended to include those compounds that have the moiety —NH— in the heterocyclic nucleus. Particularly useful silver salts are the silver salts of benzotriazole, substituted derivatives thereof, or mixtures of two or more of these salts. A silver salt of benzotriazole is most preferred.

Useful nitrogen-containing organic silver salts and methods of preparing them are also described in U.S. Pat. No. 6,977,139 (Zou et al) that is incorporated herein by reference. Such silver salts (particularly the silver benzotriazoles) are rod-like in shape and have an average aspect ratio of at least 3:1 and a width index for particle diameter of 1.25 or less. Silver salt particle length is generally less than 1 μm. Also useful are the silver salt-toner co-precipitated nanocrystals comprising a silver salt of a nitrogen-containing heterocyclic compound containing an imino group, and a silver salt comprising a silver salt of a mercaptotriazole as described in copending and commonly assigned U.S. Ser. No. 10/935,384 (filed Sep. 7, 2004 by Hasberg, Lynch, Chen-Ho, and Zou). Both of these patent applications are incorporated herein by reference.

Other organic silver salts that are useful in aqueous based thermally developable materials are silver carboxylates (both aliphatic and aromatic carboxylates) The aliphatic carboxylic acids generally have aliphatic chains that contain 10 to 30. Silver salts of long-chain aliphatic carboxylic acids having 15 to 28 carbon atoms are particulary preferred. Examples of such preferred silver salts include silver behenate, silver arachidate, silver stearate, silver oleate, silver laurate, silver caprate, silver myristate, silver palmitate, silver maleate, silver fumarate, silver tartarate, silver furoate, silver linoleate, silver butyrate, silver camphorate, and mixtures thereof. Most preferably, at least silver behenate is used alone or in mixtures with other silver carboxylates. Silver carboxylates are particularly useful aqueous latex-based thermographic and photothermographic materials.

It is also convenient to use silver half soaps such as an equimolar blend of silver carboxylate and carboxylic acid that analyzes for about 14.5% by weight solids of silver in the blend and that is prepared by precipitation from an aqueous solution of an ammonium or an alkali metal salt of a commercially available fatty carboxylic acid, or by addition of the free fatty acid to the silver soap.

The methods used for making silver soap emulsions are well known in the art and are disclosed in *Research Disclosure*, April 1983, item 22812, *Research Disclosure*, October 1983, item 23419, U.S. Pat. No. 3,985,565 (Gabrielsen et al.), and the references cited above.

While the noted organic silver salts are the predominant silver salts in the materials, secondary organic silver salts can be used if present in "minor" amounts (less than 40 mol % based on the total moles of organic silver salts).

Such secondary organic silver salts include silver salts of heterocyclic compounds containing mercapto or thione groups and derivatives thereof such as silver triazoles, oxazoles, thiazoles, thiazolines, imidazoles, diazoles, pyridines, and triazines as described in U.S. Pat. No. 4,123,274 (Knight et al.) and U.S. Pat. No. 3,785,830 (Sullivan et al.). Also included are silver salts of aliphatic carboxylic acids containing a thioether group as described in U.S. Pat. No. 3,330,663 (Weyde et al.), soluble silver carboxylates comprising hydrocarbon chains incorporating ether or thioether linkages or sterically hindered substitution in the α-(on a hydrocarbon group) or ortho- (on an aromatic group) position as described in U.S. Pat. No. 5,491,059 (Whitcomb), silver salts of dicarboxylic acids, silver salts of sulfonates as described in U.S. Pat. No. 4,504,575 (Lee), silver salts of sulfosuccinates as described in EP 0 227 141 A1 (Leenders et al.), silver salts of aromatic carboxylic acids (such as silver benzoate), silver salts of acetylenes as described, for example in U.S. Pat. No. 4,761,361 (Ozaki et al.) and U.S. Pat. No. 4,775,613 (Hirai et al.). Examples of other useful silver salts of mercapto or thione substituted compounds that do not contain a heterocyclic nucleus include silver salts of thioglycolic acids, dithiocarboxylic acids, and thioamides Sources of non-photosensitive reducible silver ions can also be in the form of core-shell silver salts as described in U.S. Pat. No. 6,355,408 (Whitcomb et al.), or the silver dimer compounds that comprise two different silver salts as described in U.S. Pat. No. 6,472,131 (Whitcomb), both references being incorporated herein by reference.

Still other useful sources of non-photosensitive reducible silver ions are the silver core-shell compounds comprising a primary core comprising one or more photosensitive silver halides, or one or more non-photosensitive inorganic metal salts or non-silver containing organic salts, and a shell at least partially covering the primary core, wherein the shell comprises one or more non-photosensitive silver salts, each of which silver salts comprises a organic silver coordinating ligand. Such compounds are described in U.S. Pat. No. 6,802,177 (Bokhonov et al.) that is incorporated herein by reference.

The one or more non-photosensitive sources of reducible silver ions (both primary and secondary organic silver salts) are preferably present in a total amount of about 5% by weight to about 70% by weight, and more preferably, about 10% to about 50% by weight, based on the total dry weight of the emulsion layers. Alternatively, the total amount of reducible silver ions is generally present in an amount of from about 0.001 to about 0.2 mol/$m^2$ of the dry photothermographic material (preferably from about 0.01 to about 0.05 mol/$m^2$).

The total amount of silver (from all silver sources) in the photothermographic materials is generally at least 0.002 mol/$m^2$ and preferably from about 0.01 to about 0.05 mol/$m^2$ for single-sided materials. For double-sided coated materials, total amount of silver from all sources would be doubled.

Reducing Agents

The reducing agent (or reducing agent composition comprising two or more components) for the source of reducible silver ions can be any material (preferably an organic material) that can reduce silver(I) ion to metallic silver. The "reducing agent" is sometimes called a "developer" or "developing agent."

When a silver benzotriazole silver source is used, ascorbic acid and reductone reducing agents are preferred. An "ascorbic acid" reducing agent means ascorbic acid, complexes, and derivatives thereof. Ascorbic acid reducing agents are described in a considerable number of publications including U.S. Pat. No. 5,236,816 (Purol et al.) and references cited therein.

Useful ascorbic acid developing agents include ascorbic acid and the analogues, isomers and derivatives thereof. Such compounds include, but are not limited to, D- or L-ascorbic acid, sugar-type derivatives thereof (such as sorboascorbic acid, γ-lactoascorbic acid, 6-desoxy-L-ascorbic acid, L-rhamno-ascorbic acid, imino-6-desoxy-L-ascorbic acid, glucoascorbic acid, fucoascorbic acid, glucoheptoascorbic acid, maltoascorbic acid, L-arabosascorbic acid), sodium ascorbate, potassium ascorbate, isoascorbic acid (or L-erythroascorbic acid), and salts thereof (such as alkali metal, ammonium or others known in the art), endiol type ascorbic acid, an enaminol type ascorbic acid, a thioenol type ascorbic acid, and an enamin-thiol type ascorbic acid, as described in EP 0 585 792A1 (Passarella et al.), EP 0 573 700A1 (Lingier et al.), EP 0 588 408A1 (Hieronymus et al.), U.S. Pat. No. 5,089,819 (Knapp), U.S. Pat. No. 2,688,549 (James et al.), U.S. Pat. No. 5,278,035 (Knapp), U.S. Pat. No. 5,384,232 (Bishop et al.), U.S. Pat. No. 5,376,510 (Parker et al.), and U.S. Pat. No. 5,498,511 (Yamashita et al.), Japanese Kokai 7-56286 (Toyoda), and *Research Disclosure*, item 37152, March 1995. Mixtures of these developing agents can be used if desired.

Particularly useful reducing agents are ascorbic acid mono- or di-fatty acid esters such as the monolaurate, monomyristate, monopalmitate, monostearate, monobehenate, diluarate, distearate, dipalmitate, dibehenate, and dimyristate derivatives of ascorbic acid as described in U.S. Pat. No. 3,832,186 (Masuda et al.) and U.S. Pat. No. 6,309,814 (Ito). Preferred ascorbic acid reducing agents and their methods of preparation are those described in U.S. Publication 2005/0164136 and U.S. Ser. No. 10/935,645 (filed on Sep. 7, 2004 by Brick, Ramsden, and Lynch), both of which are incorporated herein by reference. A preferred reducing agent is L-ascorbic acid 6-O-palmitate.

A "reductone" reducing agent means a class of unsaturated, di- or poly-enolic organic compounds which, by virtue of the arrangement of the enolic hydroxy groups with respect to the unsaturated linkages, possess characteristic strong reducing power. The parent compound, "reductone" is 3-hydroxy-2-oxo-propionaldehyde (enol form) and has the structure HOCH═CH(OH)—CHO. Examples of reductone reducing agents can be found in U.S. Pat. No. 2,691,589 (Henn et al), U.S. Pat. No. 3,615,440 (Bloom), U.S. Pat. No. 3,664,835 (Youngquist et al.), U.S. Pat. No. 3,672,896 (Gabrielson et al.), U.S. Pat. No. 3,690,872 (Gabrielson et al.), U.S. Pat. No. 3,816,137 (Gabrielson et al.), U.S. Pat. No. 4,371,603 (Bartels-Keith et al.), U.S. Pat. No. 5,712,081 (Andriesen et al.), and U.S. Pat. No. 5,427,905 (Freedman et al.), all of which references are incorporated herein by reference.

When a silver carboxylate silver source is used in a photothermographic material, one or more hindered phenol reducing agents are preferred. In some instances, the reducing agent composition comprises two or more components such as a hindered phenol developer and a co-developer that can be chosen from the various classes of co-developers and reducing agents described below. Ternary developer mixtures involving the further addition of contrast enhancing agents are also useful. Such contrast enhancing agents can be chosen from the various classes of reducing agents described below.

"Hindered phenol reducing agents" are compounds that contain only one hydroxy group on a given phenyl ring and have at least one additional substituent located ortho to the hydroxy group.

One type of hindered phenol reducing agent includes hindered phenols and hindered naphthols.

Another type of hindered phenol reducing agent are hindered bis-phenols. These compounds contain more than one hydroxy group each of which is located on a different phenyl ring. This type of hindered phenol includes, for example, binaphthols (that is dihydroxybinaphthyls), biphenols (that is dihydroxybiphenyls), bis(hydroxynaphthyl) methanes, bis(hydroxyphenyl)methanes bis(hydroxyphenyl) ethers, bis(hydroxyphenyl)sulfones, and bis (hydroxyphenyl)thioethers, each of which may have additional substituents.

Preferred hindered phenol reducing agents are bis(hydroxyphenyl)methanes such as, bis(2-hydroxy-3-t-butyl-5-methylphenyl)methane (CAO-5), 1,1'-bis(2-hydroxy-3,5-dimethylphenyl)-3,5,5-trimethylhexane (NONOX® or PERMANAX WSO), and 1,1'-bis(2-hydroxy-3,5-dimethylphenyl)-isobutane (LOWINOX® 22IB46) Mixtures of hindered phenol reducing agents can be used if desired.

An additional class of reducing agents that can be used includes substituted hydrazines including the sulfonyl hydrazides described in U.S. Pat. No. 5,464,738 (Lynch et al.). Still other useful reducing agents are described in U.S. Pat. No. 3,074,809 (Owen), U.S. Pat. No. 3,094,417 (Workman), U.S. Pat. No. 3,080,254 (Grant, Jr.), U.S. Pat. No. 3,887,417 (Klein et al.), and U.S. Pat. No. 5,981,151 (Leenders et al.). All of these patents are incorporated herein by reference.

Additional reducing agents that may be used include amidoximes, azines, a combination of aliphatic carboxylic acid aryl hydrazides and ascorbic acid, a reductone and/or a hydrazine, piperidinohexose reductone or formyl-4-methylphenylhydrazine, hydroxamic acids, a combination of azines and sulfonamidophenols, α-cyanophenylacetic acid derivatives, reductones, indane-1,3-diones, chromans, 1,4-dihydropyridines, and 3-pyrazolidones.

Useful co-developer reducing agents can also be used as described in U.S. Pat. No. 6,387,605 (Lynch et al.), U.S. Pat. No. 5,496,695 (Simpson et al.), U.S. Pat. No. 5,654,130 (Murray), U.S. Pat. No. 5,705,324 (Murray), U.S. Pat. No. 6,100,022 (Inoue et al.), U.S. Pat. No. 5,635,339 (Murray), and U.S. Pat. No. 5,545,515 (Murray et al.), all of which are incorporated herein by reference.

Various contrast enhancing agents can be used in some photothermographic materials with specific co-developers.

Examples of useful contrast enhancing agents include, but are not limited to, hydroxylamines, hydroxyamine acid compounds, N-acylhydrazine compounds, hydrogen atom donor compounds, alkanolamines and ammonium phthalamate compounds as described in U.S. Pat. No. 5,545,505 (Simpson), U.S. Pat. No. 5,545,507 (Simpson et al.), U.S. Pat. No. 5,558,983 (Simpson et al.), and U.S. Pat. No. 5,637,449 (Harring et al.), all of which are incorporated herein by reference.

When used with a silver carboxylate silver source in a thermographic material, preferred reducing agents are aromatic di- and tri-hydroxy compounds having at least two hydroxy groups in ortho- or para-relationship on the same aromatic nucleus. Examples are hydroquinone and substituted hydroquinones, catechols, pyrogallol, gallic acid and gallic acid esters (for example, methyl gallate, ethyl gallate, propyl gallate), and tannic acid.

Particularly preferred are catechol-type reducing agents having no more than two hydroxy groups in an ortho-relationship.

One particularly preferred class of catechol-type reducing agents are benzene-compounds in which the benzene nucleus is substituted by no more than two hydroxy groups which are present in 2,3-position on the nucleus and have in the 1-position of the nucleus a substituent linked to the nucleus by means of a carbonyl group. Compounds of this type include 2,3-dihydroxy-benzoic acid, and 2,3-dihydroxy-benzoic acid esters (such as methyl 2,3-dihydroxy-benzoate, and ethyl 2,3-dihydroxy-benzoate).

Another particularly preferred class of catechol-type reducing agents are benzene compounds in which the benzene nucleus is substituted by no more than two hydroxy groups which are present in 3,4-position on the nucleus and have in the 1-position of the nucleus a substituent linked to the nucleus by means of a carbonyl group. Compounds of this type include, for example, 3,4-dihydroxy-benzoic acid, 3-(3,4-dihydroxy-phenyl)-propionic acid, 3,4-dihydroxy-benzoic acid esters (such as methyl 3,4-dihydroxy-benzoate, and ethyl 3,4-dihydroxy-benzoate), 3,4-dihydroxy-benzaldehyde, 3,4-dihydroxybenzonitrile, and phenyl-(3,4-dihydroxyphenyl)ketone. Such compounds are described, for example, in U.S. Pat. No. 5,582,953 (Uyttendaele et al.).

Still another useful class of reducing agents includes polyhydroxy spiro-bis-indane compounds described as photographic tanning agents in U.S. Pat. No. 3,440,049 (Moede).

Aromatic di- and tri-hydroxy reducing agents can also be used in combination with hindered phenol reducing agents and further in combination with one or more high contrast co-developing agents and co-developer contrast-enhancing agents).

The reducing agent (or mixture thereof) described herein is generally present as 1 to 10% (dry weight) of the emulsion layer. In multilayer constructions, if the reducing agent is added to a layer other than an emulsion layer, slightly higher proportions, of from about 2 to 15 weight % may be more desirable. Co-developers may be present generally in an amount of from about 0.001% to about 1.5% (dry weight) of the emulsion layer coating.

Other Addenda

The thermally developable materials can also contain other additives where appropriate, such as shelf-life stabilizers and speed enhancing agents, antifoggants, contrast enhancing agents, toners, development accelerators, acutance dyes, post-processing stabilizers or stabilizer precursors, thermal solvents (also known as melt formers), humectants, and other image-modifying agents as would be readily apparent to one skilled in the art.

Toners are compounds that when added to the imaging layer shift the color of the developed silver image from yellowish-orange to brown-black or blue-black, and/or act as development accelerators to speed up thermal development. "Toners" or derivatives thereof that improve the black-and-white image are highly desirable components of the thermally developable materials.

Thus, compounds that either act as toners or react with a reducing agent to provide toners can be present in an amount of about 0.01% by weight to about 10% (preferably from about 0.1% to about 10% by weight) based on the total dry weight of the layer in which they are included. The amount can also be defined as being within the range of from about $1\times10^{-5}$ to about 1.0 mol per mole of non-photosensitive source of reducible silver in the photothermographic material. The toner compounds may be incorporated in one or more of the emulsion layers as well as in adjacent layers such as the outermost protective layer or underlying "carrier" layer. Toners can be located on both sides of the support if thermally developable layers are present on both sides of the support.

Compounds useful as toners are described in U.S. Pat. No. 3,074,809 (Owen), U.S. Pat. No. 3,080,254 (Grant, Jr.), U.S. Pat. No. 3,446,648 (Workman), U.S. Pat. No. 3,844,797 (Willems et al.), U.S. Pat. No. 3,847,612 (Winslow), U.S. Pat. No. 3,951,660 (Hagemann et al.), U.S. Pat. No. 4,082,901 (Laridon et al.), U.S. Pat. No. 4,123,282 (Winslow), U.S. Pat. No. 5,599,647 (Defieuw et al.), and U.S. Pat. No. 3,832,186 (Masuda et al.), and GB 1,439,478 (AGFA).

Particularly useful toners are mercaptotriazoles as described in U.S. Pat. No. 6,713,240 (Lynch et al.), the heterocyclic disulfide compounds described in U.S. Pat. No. 6,737,227 (Lynch et al.), the triazine-thione compounds described in U.S. Pat. No. 6,703,191 (Lynch et al.), and the silver salt-toner co-precipitated nano-crystals described in copending and commonly assigned U.S. Ser. No. 10/935,384 (noted above). All of the above are incorporated herein by reference.

Also useful as toners are phthalazine and phthalazine derivatives [such as those described in U.S. Pat. No. 6,146,822 (Asanuma et al.) incorporated herein by reference], phthalazinone, and phthalazinone derivatives as well as phthalazinium compounds [such as those described in U.S. Pat. No. 6,605,418 (Ramsden et al.), incorporated herein by reference].

To further control the properties of photothermographic materials, (for example, supersensitization, contrast, Dmin, speed, or fog), it may be preferable to add one or more heteroaromatic mercapto compounds or heteroaromatic disulfide compounds of the formulae Ar—S—$M^1$ and Ar—S—S—Ar, wherein $M^1$ represents a hydrogen atom or an alkali metal atom and Ar represents a heteroaromatic ring or fused heteroaromatic ring containing one or more of nitrogen, sulfur, oxygen, selenium, or tellurium atoms. Useful heteroaromatic mercapto compounds are described as supersensitizers in EP 0 559 228 B1 (Philip Jr. et al.).

The photothermographic materials can be further protected against the production of fog and can be stabilized against loss of sensitivity during storage. Suitable antifoggants and stabilizers that can be used alone or in combination include thiazolium salts as described in U.S. Pat. No. 2,131,038 (Brooker et al.) and U.S. Pat. No. 2,694,716 (Allen), azaindenes as described in U.S. Pat. No. 2,886,437 (Piper), triazaindolizines as described in U.S. Pat. No. 2,444,605 (Heimbach), urazoles as described in U.S. Pat.

No. 3,287,135 (Anderson), sulfocatechols as described in U.S. Pat. No. 3,235,652 (Kennard), oximes as described in GB 623,448 (Carrol et al.), polyvalent metal salts as described in U.S. Pat. No. 2,839,405 (Jones), and thiuronium salts as described in U.S. Pat. No. 3,220,839 (Herz).

The photothermographic materials may also include one or more polyhalo antifoggants that include one or more polyhalo substituents including but not limited to, dichloro, dibromo, trichloro, and tribromo groups. The antifoggants can be aliphatic, alicyclic or aromatic compounds, including aromatic heterocyclic and carbocyclic compounds. Particularly useful antifoggants of this type are polyhalo antifoggants, such as those having a —$SO_2C(X')_3$ group wherein X' represents the same dr different halogen atoms. Compounds having —$SO_2CBr_3$ groups are particularly preferred. Such compounds are described, for example, in U.S. Pat. No. 5,369,000 (Sakizadeh et al.), U.S. Pat. No. 5,460,938 (Kirk et al.), U.S. Pat. No. 5,464,737 (Sakizadeh et al.), U.S. Pat. No. 5,594,143 (Kirk et al.), and U.S. Pat. No. 5,374,514 (Kirk et al.).

Another class of useful antifoggants includes those compounds described in U.S. Pat. No. 6,514,678 (Burgmaier et al.), incorporated herein by reference.

Advantageously, the thermally developable materials also include one or more thermal solvents (also called "heat solvents," "thermosolvents," "melt formers," "melt modifiers," "eutectic formers," "development modifiers," "waxes," or "plasticizers"). By the term "thermal solvent" is meant an organic material that becomes a plasticizer or liquid solvent for at least one of the imaging layers upon heating at a temperature above 60° C. Representative examples of such compounds include polyethylene glycols having a mean molecular weight in the range of 1,500 to 20,000, ethylene carbonate, niacinamide, hydantoin, 5,5-dimethylhydantoin, salicylanilide, succinimide, N-hydroxy-succinimide, phthalimide, N-potassium-phthalimide, N-hydroxyphthalimide, N-hydroxy-1,8-naphthalimide, phthalazine, 1-(2H)-phthalazinone, 2-acetylphthalazinone, benzanilide, urea, 1,3-dimethylurea, 1,3-diethylurea, 1,3-diallylurea, xylitol, meso-erythritol, D-sorbitol, neopentyl glycol, 1,1,1-tris(hydroxymethyl)ethane, pentaerythritol, trimethylolpropane, tetrahydro-2-pyrimidone, glycouril, 2-imidazolidone, 2-imidazolidone-4-carboxylic acid, methyl sulfonamide, and benzenesulfonamide. Combinations of these compounds can also be used including, for example, a combination of succinimide and 1,3-dimethylurea. Known thermal solvents are disclosed, for example, in U.S. Pat. No. 3,347,675 (Henn et al.), U.S. Pat. No. 3,438,776 (Yudelson), U.S. Pat. No. 5,250,386 (Aono et al.), U.S. Pat. No. 5,368,979 (Freedman et al.), U.S. Pat. No. 5,716,772 (Taguchi et al.), and U.S. Pat. No. 6,013,420 (Windender), and in *Research Disclosure*, December 1976, item 15027. All of these are incorporated herein by reference.

Preferred thermal solvents are polyhydroxy alkanes containing 4-, 5-, and 6-carbon atoms. Many of these are reduced sugars or "sugar-like" molecules. Xylitol, pentaerythritol, D-sorbitol, trimethylolpropane, and 1,1,1-tris (hydroxymethyl)ethane are particularly preferred thermal solvents.

It may be advantageous to include a base-release agent or base precursor in the photothermographic materials. Representative base-release agents or base precursors include guanidinium compounds, such as guanidinium trichloroacetate, and other compounds that are known to release a base but do not adversely affect photographic silver halide materials, such as phenylsulfonyl acetates as described in U.S. Pat. No. 4,123,274 (Knight et al.).

Phosphors

In some embodiments, it is also effective to incorporate X-radiation-sensitive phosphors in the photothermographic materials as described in U.S. Pat. No. 6,440,649 (Simpson et al.) and U.S. Pat. No. 6,573,033 (Simpson et al.), both of which are incorporated herein by reference. Other useful phosphors are primarily "activated" phosphors known as phosphate phosphors and borate phosphors. Examples of these phosphors are rare earth phosphates, yttrium phosphates, strontium phosphates, or strontium fluoroborates (including cerium activated rare earth or yttrium phosphates, or europium activated strontium fluoroborates) as described in U.S. Ser. No. 10/826,500 (filed Apr. 16, 2004 by Simpson, Sieber, and Hansen).

The one or more phosphors used in the practice of this invention are present in the photothermographic materials in an amount of at least 0.1 mole per mole per mole of total silver in the photothermographic material.

Binders

The photosensitive silver halide (when used), the non-photosensitive source of reducible silver ions, the reducing agent, and any other additives used in the present invention are added to and coated in one or more binders using a suitable aqueous solvent. Thus, aqueous-based formulations are used to prepare the thermographic and photothermographic materials. Mixtures of different types of hydrophilic and/or hydrophobic binders can also be used. Preferably, hydrophilic polymer binders and water-dispersible polymeric latexes are used to provide aqueous-based formulations for the thermographic and photothermographic materials.

Examples of useful hydrophilic polymer binders include, but are not limited to, proteins and protein derivatives, gelatin and gelatin derivatives (hardened or unhardened), cellulosic materials, acrylamide/methacrylamide polymers, acrylic/methacrylic polymers, polyvinyl pyrrolidones, polyvinyl alcohols, poly(vinyl lactams), polymers of sulfoalkyl acrylate or methacrylates, hydrolyzed polyvinyl acetates, polyamides, polysaccharides, and other naturally occurring or synthetic vehicles commonly known for use in aqueous-based photographic emulsions (see for example *Research Disclosure*, item 38957, noted above).

Particularly useful hydrophilic polymer binders are gelatin, gelatin derivatives, polyvinyl alcohols, and cellulosic materials. Gelatin and its derivatives are most preferred, and comprise at least 75 weight % of total binders when a mixture of binders is used.

Aqueous dispersions of water-dispersible polymeric latexes may also be used, alone or with hydrophilic or hydrophobic binders described herein. Such dispersions are described in, for example, U.S. Pat. No. 4,504,575 (Lee), U.S. Pat. No. 6,083,680 (Ito et al), U.S. Pat. No. 6,100,022 (Inoue et al.), U.S. Pat. No. 6,132,949 (Fujita et al.), U.S. Pat. No. 6,132,950 (Ishigaki et al.), U.S. Pat. No. 6,140,038 (Ishizuka et al.), U.S. Pat. No. 6,150,084 (Ito et al.), U.S. Pat. No. 6,312,885 (Fujita et al.), and 6,423,487 (Naoi), all of which are incorporated herein by reference.

Minor amounts (less than 50 weight % based on total binder weight) of hydrophobic binders (not in latex form) may also be used. Examples of typical hydrophobic binders include polyvinyl acetals, polyvinyl chloride, polyvinyl acetate, cellulose acetate, cellulose acetate butyrate, polyolefins, polyesters, polystyrenes, polyacrylonitrile, polycarbonates, methacrylate copolymers, maleic anhydride ester copolymers, butadiene-styrene copolymers, and other materials readily apparent to one skilled in the art. The polyvinyl acetals (such as polyvinyl butyral and polyvinyl formal), cellulose ester polymers, and vinyl copolymers (such as polyvinyl acetate and polyvinyl chloride) are preferred. Particularly suitable binders are polyvinyl butyral resins that are available under the name BUTVAR® from Solutia, Inc. (St. Louis, Mo.) and PIOLOFORM® from Wacker Chemical Company (Adrian, Mich.) and cellulose ester polymers.

Hardeners for various binders may be present if desired. Useful hardeners are well known and include diisocyanates as described for example, in EP 0 600 586B1 (Philip, Jr. et al.) and vinyl sulfone compounds as described in U.S. Pat. No. 6,143,487 (Philip, Jr. et al.), and EP 0 640 589A1 (Gathmann et al.), aldehydes and various other hardeners as described in U.S. Pat. No. 6,190,822 (Dickerson et al.).

Where the proportions and activities of the thermally developable materials require a particular developing time and temperature, the binder(s) should be able to withstand those conditions. Generally, it is preferred that the binder does not decompose or lose its structural integrity at 120° C. for 60 seconds. It is more preferred that it does not decompose or lose its structural integrity at 177° C. for 60 seconds.

The binder(s) is used in an amount sufficient to carry the components dispersed therein. Preferably, a binder is used at a level of about 10% by weight to about 90% by weight, and more preferably at a level of about 20% by weight to about 70% by weight, based on the total dry weight of the layer in which it is included. The amount of binders on opposing sides of the support in double-sided materials may be the same or different.

Support Materials

The thermally developable materials comprise a polymeric support that is preferably a flexible, transparent film that has any desired thickness and is composed of one or more polymeric materials. They are required to exhibit dimensional stability during thermal development and to have suitable adhesive properties with overlying layers. Useful polymeric materials for making such supports include, but are not limited to, polyesters, cellulose acetate and other cellulose esters, polyvinyl acetal, polyolefins, polycarbonates, and polystyrenes. Preferred supports are composed of polymers having good heat stability, such as polyesters and polycarbonates. Polyethylene terephthalate film is a particularly preferred support. Support materials may also be treated or annealed to reduce shrinkage and promote dimensional stability.

It is useful are transparent, multilayer, polymeric supports comprising numerous alternating layers of at least two different polymeric materials as described in U.S. Pat. No. 6,630,283 (Simpson et al.) that is incorporated herein by reference. Also useful are the supports comprising dichroic mirror layers as described in U.S. Pat. No. 5,795,708 (Boutet), incorporated herein by reference.

Support materials can contain various colorants, pigments, antihalation or acutance dyes if desired. For example, blue-tinted supports are particularly useful for providing images useful for medical diagnosis. Support materials may be treated using conventional procedures (such as corona discharge) to improve adhesion of overlying layers, or subbing or other adhesion-promoting layers can be used.

Thermally Developable Formulations and Constructions

The imaging components are prepared in a formulation containing a hydrophilic polymer binder (such as gelatin, a gelatin-derivative, or a cellulosic material) or a water-dispersible polymer in latex form in an aqueous solvent such as water or water-organic solvent mixtures to provide aqueous-based coating formulations. Thus, the imaging layers on one or both sides of the support are prepared and coated out of aqueous formulations.

The thermally developable materials can contain plasticizers and lubricants such as poly(alcohols) and diols as described in U.S. Pat. No. 2,960,404 (Milton et al.), fatty acids or esters as described in U.S. Pat. No. 2,588,765 (Robijns) and U.S. Pat. No. 3,121,060 (Duane), and silicone resins as described in GB 955,061 (DuPont). The materials can also contain inorganic or organic matting agents as described in U.S. Pat. No. 2,992,101 (Jelley et al.) and U.S. Pat. No. 2,701,245 (Lynn). Polymeric fluorinated surfactants may also be useful in one or more layers as described in U.S. Pat. No. 5,468,603 (Kub).

U.S. Pat. No. 6,436,616 (Geisler et al.), incorporated herein by reference, describes various means of modifying photothermographic materials to reduce what is known as the "woodgrain" effect, or uneven optical density.

The thermally developable materials can have a protective overcoat layer (or outermost topcoat layer) disposed over the one or more imaging layers on one or both sides of the support. The binders for such overcoat layers can be any of the binders described in the Binders Section, but preferably, they are predominantly (over 50 weight %) hydrophilic binders or water-dispersible polymer latex binders. More preferably, the protective layers include gelatin or a gelatin derivative as the predominant binder(s) especially when the one or more imaging layers also include gelatin or a gelatin derivative as the predominant binder(s).

For duplitized thermally developable materials, each side of the support can include one or more of the same or different imaging layers, interlayers, and protective overcoat layers. In such materials preferably a overcoat is present as the outermost layer on both sides of the support. The layers on opposite sides can have the same or different construction and can be overcoated with the same or different protective layers.

Layers to promote adhesion of one layer to another are also known, as described in U.S. Pat. No. 5,891,610 (Bauer et al.), U.S. Pat. No. 5,804,365 (Bauer et al.), and U.S. Pat. No. 4,741,992 (Przezdziecki). Adhesion can also be promoted using specific polymeric adhesive materials as described for example in U.S. Pat. No. 5,928,857 (Geisler et al.).

The formulations described herein (including the thermographic and photothermographic formulations) can be coated by various coating procedures including wire wound rod coating, dip coating, air knife coating, curtain coating, slide coating, or extrusion coating using hoppers of the type described in U.S. Pat. No. 2,681,294 (Beguin). Layers can be coated one at a time, or two or more layers can be coated simultaneously by the procedures described in U.S. Pat. No. 2,761,791 (Russell), U.S. Pat. No. 4,001,024 (Dittman et al.), U.S. Pat. No. 4,569,863 (Keopke et al.), U.S. Pat. No. 5,340,613 (Hanzalik et al.), 5,405,740 (LaBelle), U.S. Pat. No. 5,415,993 (Hanzalik et al.), U.S. Pat. No. 5,525,376 (Leonard), U.S. Pat. No. 5,733,608 (Kessel et al.), U.S. Pat. No. 5,849,363 (Yapel et al.), U.S. Pat. No. 5,843,530 (Jerry et al.), and U.S. Pat. No. 5,861,195 (Bhave et al.), and GB 837,095 (Ilford). Atypical coating gap for the emulsion layer can be from about 10 to about 750 μm, and the layer can be dried in forced air at a temperature of from about 20° C. to about 100° C. It is preferred that the thickness of the layer be selected to provide maximum image densities greater than about 0.2, and more preferably, from about 0.5 to 5.0 or more, as measured by a MacBeth Color Densitometer Model TD 504.

Simultaneously with or subsequently to application of an emulsion formulation to the support, a protective overcoat formulation can be applied over the emulsion formulation.

Preferably, two or more layer formulations are applied simultaneously to a film support using slide coating techniques, an overcoat layer being coated on top of a photothermographic layer while the photothermographic layer is still wet.

Mottle and other surface anomalies can be reduced in the materials by incorporation of a fluorinated polymer as described in U.S. Pat. No. 5,532,121 (Yonkoski et al.) or by using particular drying techniques as described in U.S. Pat. No. 5,621,983 (Ludemann et al.).

While the overcoat and thermally developable layers can be coated on one side of the film support, manufacturing methods can also include forming on the opposing or backside of the polymeric support, one or more additional layers, including a conductive layer, an antihalation layer, or a layer containing a matting agent (such as silica), or a combination of such layers. Alternatively, one backside layer can perform all of the desired functions.

The photothermographic and thermographic materials may also usefully include a magnetic recording material as described in *Research Disclosure*, Item 34390, November 1992, or a transparent magnetic recording layer such as a layer containing magnetic particles on the underside of a transparent support as described in U.S. Pat. No. 4,302,523 (Audran et al.).

To promote image sharpness, photothermographic materials can contain one or more layers containing acutance and/or antihalation dyes that are chosen to have absorption close to the exposure wavelength and are designed to absorb scattered light. One or more antihalation compositions may be incorporated into one or more antihalation backing layers, antihalation underlayers, or as antihalation overcoats.

Dyes useful as antihalation and acutance dyes include squaraine dyes described in U.S. Pat. No. 5,380,635 (Gomez et al.) and U.S. Pat. No. 6,063,560 (Suzuki et al.), and EP 1 083 459A1 (Kimura), indolenine dyes described in EP 0 342 810A1 (Leichter), and cyanine dyes described in U.S. Pat. No. 6,689,547 (Hunt et al.), all incorporated herein by reference.

It may also be useful to employ compositions including acutance or antihalation dyes that will decolorize or bleach with heat during processing, as described in U.S. Pat. No. 5,135,842 (Kitchin et al.), U.S. Pat. No. 5,266,452 (Kitchin et al.), U.S. Pat. No. 5,314,795 (Helland et al.), and U.S. Pat. No. 6,306,566, (Sakurada et al.), and Japanese Kokai 2001-142175 (Hanyu et al.) and 2001-183770 (Hanye et al.). Useful bleaching compositions are also described in Japanese Kokai 11-302550 (Fujiwara), 2001-109101 (Adachi), 2001-51371 (Yabuki et al.), and 2000-029168 (Noro). All of the noted publications are incorporated herein by reference.

Other useful heat-bleachable backside antihalation compositions can include an infrared radiation absorbing compound such as an oxonol dye or other compounds used in combination with a hexaarylbiimidazole (also known as a "HABI"), or mixtures thereof. HABI compounds are described in U.S. Pat. No. 4,196,002 (Levinson et al.), U.S. Pat. No. 5,652,091 (Perry et al.), and U.S. Pat. No. 5,672,562 (Perry et al.), all incorporated herein by reference. Examples of such heat-bleachable compositions are described for example in U.S. Pat. No. 6,455,210 (Irving et al.), U.S. Pat. No. 6,514,677 (Ramsden et al.), and U.S. Pat. No. 6,558,880 (Goswami et al.), all incorporated herein by reference.

Under practical conditions of use, these compositions are heated to provide bleaching at a temperature of at least 90° C. for at least 0.5 seconds (preferably, at a temperature of from about 100° C. to about 200° C. for from about 5 to about 20 seconds).

Buried Conductive Compositions and Layers

The thermally developable materials have at least one buried conductive layer underneath the one or more thermographic or photothermographic emulsion layers. In preferred embodiments, it is desired that the thermally developable material contain one or more thermally developable imaging layers on both sides of the support (that is, they are duplitized), and there is also a buried conductive layer on each side of the support underneath such imaging layers.

The buried conductive layers include a conductive metal oxide such as particles of $TiO_2$, $SnO_2$, $Al_2O_3$, $ZrO_2$, $In_2O_3$, ZnO, $TiB_2$, $ZrB_2$, $NbB_2$, $TaB_2$, $CrB_2$, MoB, WB, $LaB_6$, ZrN, TiN, TiC, WC, HfC, HfN, ZrC, acicular and non-acicular zinc antimonate ($ZnSb_2O_6$), indium-doped tin oxide, antimony-doped tin oxide, aluminum-doped zinc oxide, tungsten trioxide, vanadium pentoxide, molybdenum trioxide, and niobium-doped titanium oxide. Conductive metal oxide nanoparticles are preferred and nanoparticles of non-acicular metal antimonates are more preferred. Mixtures of various types of metal oxides can be used if desired.

In most preferred embodiments, each buried conductive layer further comprises a smectite clay (preferably a montmorillonite clay) as described below. The buried conductive layer may further include an optional antihalation composition or a matting agent (such as silica), or a combination of such components. Alternatively, one buried conductive layer can perform several or all of the desired additional functions.

The conductive metal oxide is generally present in the buried conductive layer in an amount sufficient to provide a water electrode resistivity (WER) of $1\times10^{12}$ ohms/sq or less and preferably $1\times10^{11}$ ohms/sq or less at 70° F. (21.1° C.) and 30% relative humidity.

While the following disclosure is directed primarily to the use of metal antimonate particles in the "buried" conductive layer, it is to be understood that a skilled artisan would know how to adapt the teaching to the use of other conductive metal oxides known in the art.

The preferred non-acicular metal antimonate nanoparticles generally have a composition represented by the following Structure I or II:

$$M^{+2}Sb^{+5}{}_2O_6 \quad \text{(I)}$$

wherein M is zinc, nickel, magnesium, iron, copper, manganese, or cobalt, $$M_a{}^{+3}Sb^{+5}O_4 \quad \text{(II)}$$

wherein $M_a$ is indium, aluminum, scandium, chromium, iron, or gallium.

Thus, these nanoparticles are generally metal oxides that are doped with antimony.

Preferably, the non-acicular metal antimonate nanoparticles are composed of zinc antimonate ($ZnSb_2O_6$). Several conductive metal antimonates are commercially available from Nissan Chemical America Corporation. Alternatively, the metal antimonate particles can be prepared using methods described for example in U.S. Pat. No. 5,457,013 (noted above) and references cited therein.

In one embodiment, the metal antimonate nanoparticles in the buried, conductive layer are predominately in the form of non-acicular particles as opposed to "acicular" particles. By "non-acicular" particles is meant not needlelike, that is, not acicular. Thus, the shape of the metal antimonate nanoparticles can be granular, spherical, ovoid, cubic, rhombic, tabular, tetrahedral, octahedral, icosahedral, truncated cubic, truncated rhombic, or any other non-needle like shape. Non-acicular zinc antimonate ($ZnSb_2O_6$) nanoparticles are available as a 30% (solids) hydrosol dispersion in water under the tradename CELNAX® CX-Z300H.

Generally, the hydrosol dispersion comprises metal oxide nanoparticles having an average diameter of from about 15 to about 20 nm as measured across the largest particle dimension using the BET method.

The metal oxide particles (such as the preferred non-acicular metal antimonate nanoparticles) generally comprise from about more than 40 and up to about 85% (preferably from about 60 to about 80%) by weight of the dry conductive layer. Thus, the weight % of the polymer mixture in the dry conductive layer is from about 15 to about 60 weight % and preferably from about 20 to about 40 weight %. Another way of defining the amount of particles is that they are generally present in the conductive layer in an amount of from about 0.05 to about 1.0 g/m$^2$ (preferably from about 0.1 to about 0.7 g/m$^2$) of the dry layer coverage. The optimum ratio of total binder to conductive particles can vary depending upon the specific conductive particles and binders used, the conductive particle size, the coverage of conductive particles, the dry thickness of the conductive layer, and the dry thickness of adjacent layers. One skilled in the art would be able to determine the optimum parameters to achieve the desired conductivity and adhesion to adjacent layers and/or support.

Various methods describing the preparation of conductive layers are described in U.S. Pat. No. 6,689,546 (LaBelle et al.) and in copending and commonly assigned U.S. Ser. No. 10/930,428 (filed Aug. 31, 2004 by Ludemann, LaBelle, Koestner, Hefley, Bhave, Geisler, and Philip), Ser. No. 10/930,438 (filed Aug. 31, 2004 by Ludemann, LaBelle, Philip, Koestener, and Bhave), and Ser. No. 10/978,205 (filed Oct. 29, 2004 by Ludemann, LaBelle, Koestener, and Chen) (all noted above), all of which are incorporated herein by reference.

The conductive metal oxide is present in one or more conductive layers that are "buried" beneath the thermally developable imaging layer(s). The relationship of the buried, conductive layer(s), and the layer or layers immediately adjacent is important because the types of polymers and binders in these layers are designed to provide excellent adhesion to one another as well as acceptably dispersing the conductive metal oxide and/or other layer components, and are readily coated simultaneously.

The buried conductive layer can have a dry thickness of from about 0.05 to about 2.2 μm (preferably from about 0.07 to about 0.1 μm). The "buried" conductive layers can be provided as "carrier" layers and thus, be relatively thin in dry thickness. The term "carrier layer" is often used when multiple layers are coated using slide coating and the buried conductive layer is a thin layer adjacent to the support.

In one preferred embodiment, the buried conductive layer is a carrier layer and is directly disposed on the support without the use of primer or subbing layers, or other adhesion-promoting means such as support surface treatments. Thus, the support can be used in an "untreated" and "uncoated" form when a buried conductive carrier layer is used. The carrier layer formulation is applied simultaneously with application of these other layer formulations and is thereby located underneath these other layers. In one construction, the conductive carrier layer formulation comprises a single-phase mixture of a hydrophilic (such as gelatin) or water-dispersible binder and a suitable conductive component such as non-acicular metal antimonate particles.

It is preferred that the binders for the buried conductive layer(s) are hydrophilic. However hydrophobic polymers such as water-dispersible polymer latexes can be used if they are soluble or dispersible in aqueous solvents. Thus, the buried conductive layers containing metal oxides are generally coated out of one or more aqueous solvents. These hydrophilic solvents may contain a small amount (less that 20%, and preferably less than 10%) of a hydrophobic organic solvent such as methyl ethyl ketone, or toluene.

The buried conductive layers and at least one thermally developable layer can be simultaneously (wet-on-wet) coated using various coating procedures such as wire wound rod coating, dip coating, air knife coating, curtain coating, slide coating, or slot-die coating, extrusion coating. These procedures are the same as those described above.

In addition to the conductive particles described above, other conductive materials may be present in either the buried conductive layer or other layers. Such compositions include fluorochemicals that are described in U.S. Pat. No. 6,699,648 (Sakizadeh et al.) and U.S. Pat. No. 6,762,013 (Sakizadeh et al.). Both of these patents are incorporated herein by reference.

Smectite Clays

In most preferred embodiments, the buried conductive layer(s) contain a smectite clay. Smectite clays are a family of clays that swell (or exfoliate) when immersed in water or certain polar organic liquids (those which, like water, have polar molecules). Exfoliation expands the surface area of the clay and permits intercalation of the ammonium compounds between layers of the clay. At one time smectite clays were known as the montmorillonite group, however that name is now only used for one mineral within the smectite group. All smectite clays have very high cation exchange capacity (of the order of 1,000 meq/kg=1 mmole of positive charge per gram).

Smectite clays include montmorillonite, nontronite, beidellite, volkonskoite, hectorite, saponite, sauconite, sobockite, stevensite, svinfordite, halloysite, magadiite, and kenyaite. The smectite clay can be naturally-occurring or synthetically-prepared. Typically, synthetically-prepared clays are smaller in lateral dimension and therefore possess a smaller aspect ratio. Synthetically-prepared clays are purer and are of narrower size distribution, compared to naturally-occurring clays and may not require any further purification or separation before modification. Mixtures of two or more of such clays (both naturally-occurring and synthetically-prepared) can be used in this invention.

Smectite clays are described for example in U.S. Pat. No. 4,150,578 (Finlayson et al.), U.S. Pat. No. 5,110,501 (Knudson, Jr. et al.), U.S. Pat. No. 5,739,087 (Dennis), U.S. Pat. No. 6,036,765 (Farrow et al.), U.S. Pat. No. 6,787,592 (Powell et al.), and U.S. Pat. No. 5,981,126 (Majumdar et al.).

A preferred smectite clay is montmorillonite, an aluminum magnesium silicate clay having the approximate formula:

$$R^+_{0.33}(Al,Mg)_2Si_4O_{10}(OH)_2.n(H_2O)$$

wherein $R^+$ includes one or more suitable cation such as $Na^+$, $K^+$, $Mg^{2+}$, $NH_4^+$, and $Ca^{2+}$. (See Merck Index, Ninth Ed., Merck & Co., Rahway N.J. item 6095). More preferably, $R^+$ is predominantly (greater than 50%) $Na^+$.

The buried conductive layer generally contains the smectite clay in an amount of from about 0.5 to about 15 weight %, and preferably from about 0.1 to about 10 weight %, based on the total dry binder weight. Another way of defining the amount of smectite clay is in an amount of about 2 to about 12 g/m$^2$. Moreover, the weight ratio of the conductive metal particles to the smectite clay is generally from about 10:1 to about 150:1.

Lithium Salts

One or more lithium salts are present in one or more layers of the thermally developable materials. The salts can be placed in the thermographic or photothermographic imaging layers, overcoat layers (including the outermost protective layer), and layers between the support and thermally developable imaging layers on one or both sides of the support. Preferably, they are in an overcoat layer or in the buried conductive layer disposed under the thermally developable imaging layer that may be also a "carrier" layer on each side of the support that contains a thermally developable imaging layer. This carrier layer can also be a conductive layer as described above. The lithium salts can be present any of these layers even in the absence of a conductive layer.

Useful lithium salts include lithium salts of perfluorinated sulfonyl amides and inorganic lithium salts. Addition of lithium salts that would adversely react with other active ingredients, such as diffusion of lithium chloride, bromide and iodide into the emulsion layer, is to be avoided.

Representative useful lithium salts include compounds LS-1 and LS-2.

(LS-1)

$LiNO_3$ (LS-2)

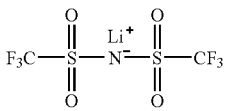

The lithium salt(s) are present in an amount of at least 0.00005 mol/m$^2$ and preferably from about 0.0001 to about 0.01 mol/m$^2$.

The inorganic lithium salts useful herein can be obtained from a number of commercial sources including Alfa Aesar (Ward Hill, Mass.).

Imaging/Development

The photothermographic materials can be imaged in any suitable manner consistent with the type of material, using any suitable imaging source (typically some type of radiation or electronic signal). In some embodiments, the materials are sensitive to radiation in the range of from about at least 100 nm to about 1400 nm, and normally from about 300 nm to about 850 nm (preferably from about 300 to about 600 nm, more preferably from about 300 to about 450 nm, even more preferably from a wavelength of from about 360 to 420 nm, and most preferably from about 380 to about 420 nm), using appropriate spectral sensitizing dyes.

Imaging can be achieved by exposing the photothermographic materials to a suitable source of radiation to which they are sensitive, including X-radiation, ultraviolet radiation, visible light, near infrared radiation, and infrared radiation to provide a latent image. Suitable exposure means are well known and include incandescent or fluorescent lamps, xenon flash lamps, lasers, laser diodes, light emitting diodes, infrared lasers, infrared laser diodes, infrared light-emitting diodes, infrared lamps, or any other ultraviolet, visible, or infrared radiation source readily apparent to one skilled in the art such as described in *Research Disclosure*, item 38957 (noted above). Particularly useful infrared exposure means include laser diodes, including laser diodes that are modulated to increase imaging efficiency using what is known as multi-longitudinal exposure techniques as described in U.S. Pat. No. 5,780,207 (Mohapatra et al.). Other exposure techniques are described in U.S. Pat. No. 5,493,327 (McCallum et al.).

The photothermographic materials also can be indirectly imaged using an X-radiation imaging source and one or more prompt-emitting or storage X-radiation sensitive phosphor screens adjacent to the photothermographic material. The phosphors emit suitable radiation to expose the photothermographic material. Preferred X-ray screens are those having phosphors emitting in the near ultraviolet region of the spectrum (from 300 to 400 nm), in the blue region of the spectrum (from 400 to 500 nm), and in the green region of the spectrum (from 500 to 600 nm).

In other embodiments, the photothermographic materials can be imaged directly using an X-radiation imaging source to provide a latent image.

Thermal development conditions will vary, depending on the construction used but will typically involve heating the photothermographic material at a suitably elevated temperature, for example, at from about 50° C. to about 250° C. (preferably from about 80° C. to about 200° C. and more preferably from about 100° C. to about 200° C.) for a sufficient period of time, generally from about 1 to about 120 seconds. Heating can be accomplished using any suitable heating means. A preferred heat development procedure for photothermographic materials includes heating at from 130° C. to about 165° C. for from about 3 to about 25 seconds.

When imaging thermographic materials, the image may be "written" simultaneously with development at a suitable temperature using a thermal stylus, a thermal print-head or a laser, or by heating while in contact with a heat-absorbing material. The thermographic materials may include a dye (such as an IR-absorbing dye) to facilitate direct development by exposure to laser radiation.

Thermal development of both photothermographic and thermographic materials is carried out with the materials being in a substantially water-free environment and without application of any solvent to the materials.

Use as a Photomask

In some embodiments, the thermally developable materials are sufficiently transmissive in the range of from about 350 to about 450 nm in non-imaged areas to allow their use in a method where there is a subsequent exposure of an ultraviolet or short wavelength visible radiation sensitive imageable medium. The thermally developed materials absorb ultraviolet or short wavelength visible radiation in the areas where there is a visible image and transmit ultraviolet or short wavelength visible radiation where there is no visible image. The materials may then be used as a mask and positioned between a source of imaging radiation (such as an ultraviolet or short wavelength visible radiation energy source) and an imageable material that is sensitive to such imaging radiation, such as a photopolymer, diazo material, photoresist, or photosensitive printing plate.

These embodiments of the imaging method of this invention are carried out using the following Steps (A') or (A) and (B) noted above and the following Steps (C) and (D):

(C) positioning the exposed and photothermographic material with the visible image therein between a source of imaging radiation and an imageable material that is sensitive to the imaging radiation, and (D) exposing the imageable material to the imaging radiation through the visible image in the exposed and photothermographic material to provide an image in the imageable material.

Imaging Assemblies

In some embodiments, the photothermographic materials are used or arranged in association with one or more phosphor intensifying screens and/or metal screens in what is known as "imaging assemblies." Duplitized visible light sensitive photothermographic materials are preferably used in combination with two adjacent intensifying screens, one screen in the "front" and one screen in the "back" of the material. The front and back screens can be appropriately chosen depending upon the type of emissions desired, the desired photicity, and emulsion speeds. The imaging assemblies can be prepared by arranging the photothermographic material and one or more phosphor intensifying screens in a suitable holder (often known as a cassette), and appropriately packaging them for transport and imaging uses.

There are a wide variety of phosphors known in the art that can be formulated into phosphor intensifying screens as described in hundreds of publications. U.S. Pat. No. 6,573,033 (noted above) describes phosphors that can be used in this manner. Particularly useful phosphors are those that emit radiation having a wavelength of from about 300 to about 450 nm and preferably radiation having a wavelength of from about 360 to about 420 nm.

Preferred phosphors useful in the phosphor intensifying screens include one or more alkaline earth fluorohalide phosphors and especially the rare earth activated (doped) alkaline earth fluorohalide phosphors. Particularly useful phosphor intensifying screens include a europium-doped barium fluorobromide ($BaFBr_2$:Eu) phosphor. Other useful phosphors are described in U.S. Pat. No. 6,682,868 (Dickerson et al.) and references cited therein, all incorporated herein by reference.

The following examples are provided to illustrate the practice of the present invention and the invention is not meant to be limited thereby.

Materials and Methods for the Examples:

All materials used in the following examples are readily available from standard commercial sources, such as Aldrich Chemical Co. (Milwaukee, Wis.) unless otherwise specified. All percentages are by weight unless otherwise indicated. The following additional materials were prepared and used as follows.

BYK-022 is a defoamer and is available from Byk-Chemie Corp. (Wallingford, Conn.).

BZT is benzotriazole. AgBZT is silver benzotriazole. NaBZT is the sodium salt of benzotriazole.

CELNAX® CX-Z300H is a hydrosol dispersion containing 30% of non-acicular zinc antimonate particles in water. It was obtained from Nissan Chemical America Corporation (Houston, Tex.). Unless otherwise indicated, when referring to "CELNAX®" in the following examples, reference is being made to the non-acicular zinc antimonate particles, not the aqueous hydrosol "dispersion" of metal oxide particles.

CELVOL® V203S and CELVOL® V603 are polyvinyl alcohols and are available from Celanese Corp. (Dallas, Tex.).

CLOISITE® $Na^+$ is a natural montmorillonite clay and is available from Southern Clay Products (Gonzales, Tex.). Sodium is the predominant cation.

Mayer Bars are ½ inch diameter Type 303 Stainless Steel coating rods and are available from R.D. Specialties, Inc. (Webster, N.Y.).

TRITON® X-114 is a nonionic surfactant and is available from Dow Chemical Corp. (Midland Mich.).

ZONYL® FS300 is a nonionic fluorosurfactant that is available from E. I. DuPont de Nemours & Co. (Wilmington, Del.).

Compound LS-2 is lithium bis(trifluoromethanesulfonyl) imide. It is also known as FLUORAD® HQ-115 and is available from 3M Company (Maplewood, Minn.).

Compound A-1 is described in U.S. Pat. No. 6,605,418 (noted above) and is believed to have the structure shown below.

(A-1)

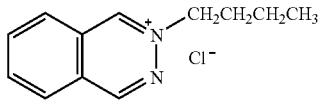

Compound SS-1a is described in U.S. Pat. No. 6,296,998 (Eikenberry et al.) and is believed to have the structure shown below.

(SS-1a)

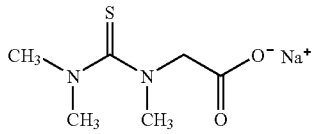

Compound VS-1 is 1,1'(methylenebis(sulfonyl))bisethene and is described in EP 0 640 589 A1 (Gathmann et al.). It is believed to have the structure shown below.

(VS-1)

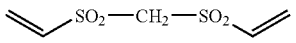

Compound T-1 is 2,4-dihydro-4-(phenylmethyl)-3H-1,2,4-triazole-3-thione. It is believed to have the structure shown below. It may also exist as the thione tautomer. The silver salt of this compound is referred to as AgT-1. The sodium salt of this compound is referred to as NaT-1.

(T-1)

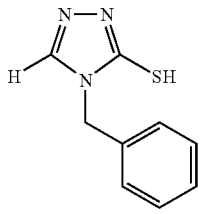

Blue sensitizing dye SSD-1 is believed to have the structure shown below.

(SSD-1)

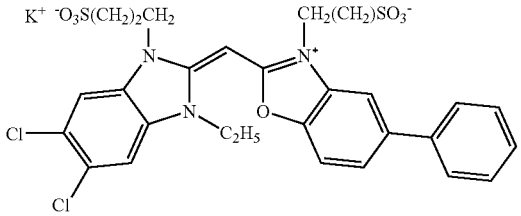

Compound D-1 is L-ascorbic acid 6-O-palmitate and is available from Alfa Aesar Corp., (Ward Hill, Mass.). It is believed to have the structure shown below.

(D-1)

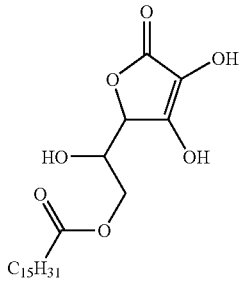

Compound S-1 is S-octadecyl phenylcarbamothioate. It has the structure shown below and was prepared as described in copending and commonly assigned U.S. Ser. No. 11/025,633 (filed on Dec. 29, 2004 by Ramsden, Philip, Lynch, Chen-Ho, Ulrich, Sakizadeh, Leon, and Burgmaier) that is incorporated herein by reference.

(S-1)

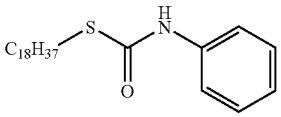

Compound S-2 is the sodium salt of 5-bromo-4-hydroxy-6-methyl-1,3,3a,7-tetraazaindene [6-bromo-5-methyl-(1,2,4)triazolo(1,5-a)pyrimidin-7-ol]. It was prepared by adding 5.0 g of 2N NaOH in 92.5 g of water to 2.67 g of 5-bromo-4-hydroxy-6-methyl-1,3,3a,7-tetraazaindene. It is believed to have the structure shown below.

(S-2)

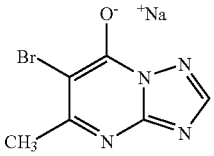

Compound S-3 is a 10:1 mixture of the compounds shown below.

(S-3)

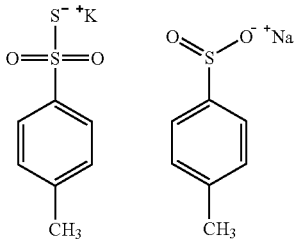

Gold sensitizer Compound GS-1 is believed to have the structure shown below.

(GS-1)

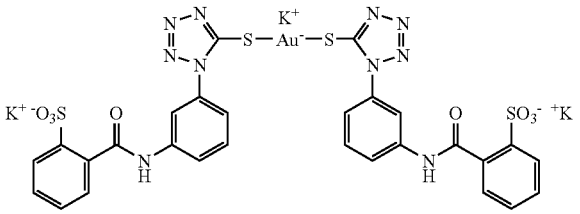

Preparation of Compound S-1-A Dispersion:

An aqueous slurry containing Compound S-1, CELVOL® V603 poly(vinyl alcohol), and BYK-022 was milled on a ball mill. The poly(vinyl alcohol) and BYK-022 were added at a level of 15.0%, and 0.1% by weight of S-1, respectively. The finished dispersion had an average particle size of 0.84 μM with 7.5% S-1.

Preparation of Compound S-1-B Dispersion:

An aqueous slurry containing Compound S-1, CELVOL® V603 poly(vinyl alcohol), and BYK-022 was milled on a ball mill. The poly(vinyl alcohol) and BYK-022 were added at a level of 15.0%, and 0.1% by weight of S-1, respectively. The finished dispersion had an average particle size of 0.83 μn with 7.52% S-1.

Preparation of Compound D-1-A Dispersion:

An aqueous slurry containing Compound D-1, CELVOL® 203S poly(vinyl alcohol), TRITON® X-114 surfactant, and BYK-022 was milled with 0.7 mm zirconium silicate ceramic beads. The poly(vinyl alcohol), TRITON® X-14 surfactant, and BYK-022 were added at a level of 10.0%, 3.0%, and 0.1% by weight of Compound D-1, respectively. The finished dispersion had an average particle size of 0.44 μm with 31.57% of Compound D-1.

Preparation of Compound D-1-B Dispersion:

An aqueous slurry containing Compound D-1, CELVOL® 203S poly(vinyl alcohol), TRITON® X-114 surfactant, monopalmitin, and BYK-022 was milled with 0.7 mm zirconium silicate ceramic beads. The poly(vinyl alcohol), TRITON® X-14 surfactant, monpalmitin, and BYK-022 were added at a level of 10.0%, 3.0%, 3.0%, and 0.1% by weight of D-1, respectively. A 15 ppm addition of Kathon was also added. The finished dispersion had an average particle size of 0.36 μm with 30.46% D-1.

Preparation of AgBZT/AgT-1 Co-Precipitated Emulsion:

A co-precipitated AgBZT/AgT-1 emulsion was prepared as described in copending and commonly assigned U.S. Ser.

No. 10/935,384 (filed on Sep. 7, 2004 by Hasberg, Lynch, Chen-Ho, and Zou) that is incorporated herein by reference.

A stirred reaction vessel was charged with 900 g of lime-processed gelatin, and 6000 g of deionized water. The mixture in the reaction vessel was adjusted to a pH of 8.9 with 2.5N sodium hydroxide solution, and 0.8 g of Solution A (prepared below) was added to adjust the solution vAg to 80 mV. The temperature of the reaction vessel was maintained at approximately 50° C.

Solution A was prepared containing 216 g/kg of benzotriazole, 710 g/kg of deionized water, and 74 g/kg of sodium hydroxide.

Solution B was prepared containing 362 g/kg of silver nitrate and 638 g/kg of deionized water.

Solution C was prepared containing 336 g/kg of Compound T-1, 70 g/kg of sodium hydroxide and 594 g/kg of deionized water.

Solutions A and B were then added to the reaction vessel by conventional controlled double-jet addition. Solution B was continuously added at the flow rates and for the times given below, while maintaining constant vAg and pH in the reaction vessel. After consumption of 97.4% total silver nitrate solution (Solution B), Solution A was replaced with Solution C and the precipitation was continued. Solution B and Solution C were added to the reaction vessel also by conventional controlled double-jet addition, while maintaining constant vAg and pH in the reaction vessel.

The AgBZT/AgT-1 co-precipitated emulsions were washed by conventional ultrafiltration process as described in *Research Disclosure*, Vol. 131, March 1975, Item 13122. ThepH of AgBZT/AgT-1 emulsions was adjusted to 6.0 using 2.0N sulfuric acid. Upon cooling the emulsion solidified and was stored.

| | Time [min] | Solution B Flow Rate [ml/min] |
|---|---|---|
| Flow Rate 1 | 20 | 25 |
| Flow Rate 2 | 41 | 25–40 |
| Flow Rate 3 | 30 | 40–80 |

Preparation of Ultra-Thin Tabular Grain Silver Halide Emulsion

A reaction vessel equipped with a stirrer was charged with 6 liters of water containing 2.1 g of deionized oxidized-methionine lime-processed bone gelatin, 3.49 g of sodium bromide, and an antifoamant (at pH=5.8). The solution was held at 39° C. for 5 minutes. Simultaneous additions were then made of 50.6 ml of 0.3 molar silver nitrate and 33.2 ml of 0.448 molar sodium bromide over 1 minute. Following nucleation, 3.0 ml of a 0.1 M solution of sulfuric acid was added. After 1 minute 15.62 g sodium chloride plus 375 mg of sodium thiocyanate were added and the temperature was increased to 54° C. over 9 minutes. After a 5-minute hold, 79.6 g of deionized oxidized-methionine lime-processed bone gelatin in 1.52 liters of water containing additional antifoamant at 54° C. were then added to the reactor. The reactor temperature was held for 7 minutes (pH=5.6).

During the next 36.8 minutes, the first growth stage took place (at 54° C.), in three segments, wherein solutions of 0.3 molar $AgNO_3$, 0.448 molar sodium bromide, and a 0.16 molar suspension of silver iodide (Lippmann) were added to maintain a nominal uniform iodide level of 3.2 mole %. The flow rates during this growth stage were increased from 9 to 42 ml/min (silver nitrate) and from 0.73 to 3.3 ml/min (silver iodide). The flow rates of the sodium bromide were allowed to fluctuate as needed to affect a monotonic pBr shift of 2.45 to 2.12 over the first 12 minutes, of 2.12 to 1.90 over the second 12 minutes, and of 1.90 to 1.67 over the last 12.8 minutes. This was followed by a 1.5 minute hold.

During the next 59 minutes the second growth stage took place (at 54° C.) during which solutions of 2.8 molar silver nitrate, and 3.0 molar sodium bromide, and a 0.16 molar suspension of silver iodide (Lippmann) were added to maintain a nominal iodide level of 3.2 mole %. The flow rates during this segment were increased from 10 to 39.6 ml/min (silver nitrate) and from 5.3 to 22.6 ml/min (silver iodide). The flow rates of the sodium bromide were allowed to fluctuate as needed to affect a monotonic pBr shift of 1.67 to 1.50. This was followed by a 1.5 minute hold.

During the next 34.95 minutes, the third growth stage took place during which solutions of 2.8 molar silver nitrate, 3.0 molar sodium bromide, and a 0.16 molar suspension of silver iodide (Lippmann) were added to maintain a nominal iodide level of 3.2 mole %. The flow rates during this segment were 39.6 ml/min (silver nitrate) and 22.6 ml/min (silver iodide). The temperature was linearly decreased to 35° C. during this segment. At the $23^{rd}$ minute of this segment a 50 ml aqueous solution containing 0.85 mg of an Iridium dopant ($K_2$[Ir(5-Br-thiazole)$Cl_5$]) was added. The flow rate of the sodium bromide was allowed to fluctuate to maintain a constant pBr of 1.50.

A total of 8.5 moles of silver iodobromide (3.2% bulk iodide) were formed. The resulting emulsion was washed using ultrafiltration. Deionized lime-processed bone gelatin (326.9 g) was added along with a biocide and pH and pBr were adjusted to 6 and 2.5 respectively.

The resulting emulsion was examined by Scanning Electron Microscopy. Tabular grains accounted for greater than 99% of the total projected area. The mean ECD of the grains was 2.24 am. The mean tabular thickness was 0.045 μm.

This emulsion was spectrally sensitized with 3.5 mmol of blue sensitizing dye SSD-1 per mole of silver halide. This dye quantity was split 80%/20% with the majority being added before chemical sensitization and the remainder afterwards. Chemical sensitization was carried out using 0.0085 mmol of sulfur sensitizer (compound SS-1 a) and 0.00079 mmol per mole of silver halide of gold sensitizer (compound GS-1) at 60° C. for 6.3 minutes.

Resistivity Measurements:

Resistivity of the overcoated antistatic coatings was measured using a "water electrode resistivity" (WER) test in which the internal resistivity of the overcoated electrically conductive antistatic layer is measured using a salt bridge wet electrode resistivity measurement technique. This technique is described in R. A. Elder *Resistivity Measurements on Buried Conductive Layers*, EOS/ESD Symposium Proceedings, Lake Buena Vista, Fla., 1990, pp. 251–254, incorporated herein by reference [EOS/ESD stands for Electrical Overstress/Electrostatic Discharge]. A Keithley Electrometer Model 6517A was used. Typically, antistatic layers with WER values greater than about $1\times10^{12}$ ohm/square are considered to be ineffective at providing static protection for photographic imaging elements. WER values of $1\times10^{11}$ or less at 70° F. (21.1° C.) and 30% Relative Humidity are preferred. We have also found WER measurements to be more predictive of how an antistatic material will perform when used in a commercial product.

EXAMPLE 1

Evaluation of Zinc Antimonate Underlayer with an Aqueous Photothermopraphic Silver Layer and a Gelatin Overcoat Preparation of Photothermographic Materials:

Component A: A portion of hydrated gelatin (5% de-ionized lime-processed gelatin/95% water) was placed in a beaker and melted by heating at 40° C. for 10 minutes. The melt was added to a 30% aqueous solution of CELNAX® CX-Z300H metal oxide dispersion. An aqueous solution containing 4% Zonyl® FS-300 surfactant was then added.

Component B: A 1.7% aqueous solution of Compound VS-1 was prepared by dissolving Compound VS-1 in water at 50° C.

Component C: The AgBZT/AgT-1 co-precipitated emulsion prepared above and hydrated gelatin (35% gelatin/65% water) were placed in a beaker and heated to 50° C. for 15 minutes. A 5% aqueous solution of 3-methylbenzothiazolium iodide was added and the mixture was heated for 15 minutes at 50° C. A 0.73 molar aqueous solution of the sodium salt of benzotriazole was added and the mixture was heated for 10 minutes at 50° C. The mixture was cooled to 40° C. and its pH was adjusted to 5.0 with 2.5N sulfuric acid. A 18% aqueous solution of Compound A-1 was added and the mixture was heated for 10 minutes at 40° C. An aqueous solution containing 4% Zonyl® FS-300 surfactant was then added and the mixture was held at 40° C.

Component D: A portion of the ultra-thin tabular grain silver halide emulsion prepared as described above was placed in a beaker and melted at 40° C.

Component E: A mixture of 1,3-dimethylurea, succinimide, and xylitol was dissolved in water by heating at 50° C. Dispersions of D-1-A and S-1-A described above were added to the above solution at room temperature.

Component F: A portion of hydrated gelatin (23% de-ionized lime-processed gelatin/77% water) was placed in a beaker and melted by heating at 40° C. for 10 minutes. The melted gelatin was then added to a 20% aqueous solution of 1,3-dimethylurea, a 5% aqueous solution of boric acid, and a 4% active aqueous solution of Zonyl® FS-300 surfactant.

Component G: A 1.7% aqueous solution of Compound VS-1 was prepared by dissolving Compound VS-1 in water at 50° C.

Coating and Evaluation of Photothermographic Materials:

Components A and B were mixed immediately before coating to form the conductive underlayer formulation, components C, D, and E were mixed immediately before coating to form a photothermographic emulsion formulation, and components F and G were mixed immediately before coating to form a overcoat formulation.

The conductive underlayer formulations were coated onto a 7 mil (178 μm) transparent, blue-tinted poly(ethylene terephthalate) film support and dried at 113° F. (48.9° C.) for 11 minutes to achieve the dry coating weights shown in TABLE 1.

After 24 hours, the photothermographic and overcoat formulations were simultaneously dual-coated over the conductive underlayer using a conventional automated dual-knife coating machine and dried at 113° F. (48.9° C.) for 11 minutes. The coating gaps for the photothermographic and overcoat layers were adjusted to achieve the dry coating weights shown in TABLE II. Sample 1-1-C contained no underlayer. It served as a control.

TABLE I

| Sample | Gelatin:Metal Oxide Ratio | Metal Oxide (mg/ft$^2$) | Metal Oxide [mg/m$^2$] | Gelatin (mg/ft$^2$) | Gelatin [mg/m$^2$] | Zonyl ® FS-300 Surfactant (mg/ft$^2$) | Zonyl ® FS-300 Surfactant [mg/m$^2$] | Compound VS-1 (mg/ft$^2$) | Compound VS-1 [mg/m$^2$] |
|---|---|---|---|---|---|---|---|---|---|
| 1-1-C | — | — | | — | | — | | — | |
| 1-2 | 1:2 | 28 | 301 | 14 | 151 | 0.45 | 4.84 | 0.28 | 3.01 |
| 1-3 | 1:2 | 78 | 839 | 39 | 420 | 1.25 | 13.5 | 0.77 | 8.29 |
| 1-4 | 1:3 | 33 | 355 | 11 | 118 | 0.35 | 3.77 | 0.22 | 2.37 |
| 1-5 | 1:3 | 74 | 796 | 25 | 269 | 0.79 | 8.50 | 0.49 | 5.27 |
| 1-6 | 1:4 | 31 | 334 | 8 | 86 | 0.25 | 2.69 | 0.15 | 1.61 |
| 1-7 | 1:4 | 65 | 699 | 16 | 172 | 0.52 | 2.69 | 0.32 | 3.44 |

TABLE II

| Component | Compound | Dry Coating Weight - (g/m$^2$) |
|---|---|---|
| | Conductive Underlayer | |
| A | CELNAX ® CX-Z300H | See Table II |
| A | Gelatin | See Table II |
| A | Zonyl ® FS-300 surfactant | See Table II |
| A | Compound VS-1 | See Table II |
| | Photothermographic Layer | |
| C | Silver (from AgBZT/Ag T-1) | 1.44 |
| C | Lime processed gelatin | 2.02 |
| C | 3-Methylbenzothiazolium Iodide | 0.072 |
| C | Sodium benzotriazole | 0.085 |
| C | Compound A-1 | 0.073 |
| C | Zonyl ® FS-300 surfactant | 0.021 |
| D | Silver (from AgBrI emulsion) | 0.25 |
| E | Succinimide | 0.18 |
| E | 1,3-Dimethylurea (1,3-DMU) | 0.29 |
| E | Xylitol | 0.47 |
| E | Compound S-1-A | 0.035 |
| E | Compound D-1-A | 3.69 |
| | Overcoat Layer | |
| F | De-ionized lime-processed gelatin | 1.54 |
| F | Boric acid | 0.061 |
| F | 1,3-Dimethylurea (1,3-DMU) | 0.25 |
| F | Zonyl ® FS-300 surfactant | 0.038 |
| G | Compound VS-1 | 0.093 |

The resulting photothermographic films were imagewise exposed using a sensitometer equipped with filters to provide an exposure simulating a phosphor emitting at 390 to 395 nm. Exposure was for 1/10 second using a 3000° K. tungsten lamp. Following exposure, the films were developed on a heated flat bed processor for 18 seconds at 150°

C. to generate continuous tone wedges. These samples provided initial Dmin, Dmax and Speed-2.

Densitometry measurements were made on a custom built computer-scanned densitometer meeting ISO Standards 5-2 and 5-3 and are believed to be comparable to measurements from commercially available densitometers. Density of the wedges was measured with above computer densitometer using a filter appropriate to the sensitivity of the photothermographic material to obtain graphs of density versus log exposure (that is, D log E curves). Dmin is the density of the non-exposed areas after development and it is the average of the eight lowest density values.

The resistivity of the photothermographic material was measured using the Water Electrode Resistivity (WER) test method described above. Samples were equilibrated at 70.1° F. (21.2° C.) and 32% relative humidity for 24 hours prior to testing.

The results, shown below in TABLE III, demonstrate improved conductivity with the addition of a metal oxide conductive underlayer. Increased amounts of metal oxide resulted in further increased conductivity. Little if any effect on the initial Dmin, Dmax, or Speed-2 with the addition of the conductive underlayer was seen. Any differences appear to be due to higher coating weights of the photothermographic layer as compared to the control rather than interaction from the conductive underlayer.

TABLE III

| Sample | Dmin | Dmax | Speed-2 | log WER (ohm/sq) |
|---|---|---|---|---|
| 1-1-C | 0.306 | 2.321 | 5.615 | 12.8 |
| 1-2 | 0.307 | 2.492 | 5.528 | 10.2 |
| 1-3 | 0.319 | 2.843 | 5.560 | 9.6 |
| 1-4 | 0.305 | 2.457 | 5.579 | 9.5 |
| 1-5 | 0.309 | 2.370 | 5.691 | 8.9 |
| 1-6 | 0.309 | 2.340 | 5.678 | 9.6 |
| 1-7 | 0.306 | 2.393 | 5.700 | 8.5 |

EXAMPLE 2

Evaluation of Zinc Antimonate Underlayer with an Aqueous Photothermographic Silver Layer and a Gelatin Overcoat Preparation of Photothermographic Materials:

Component A: A portion of hydrated gelatin (5% deionized lime-processed gelatin/95% water) was placed in a beaker and melted by heating at 40° C. for 10 minutes. The melt was added to a 30% aqueous solution of CELNAX® CX-Z300H metal oxide dispersion. An aqueous solution containing 4% Zonyl® FS-300 surfactant was then added.

Component B: A 1.7% aqueous solution of Compound VS-1 was prepared by dissolving Compound VS-1 in water at 50° C.

Component C: The AgBZT/AgT-1 co-precipitated emulsion prepared above and hydrated gelatin (35% gelatin/65% water) were placed in a beaker and heated to 50° C. for 15 minutes. A 5% aqueous solution of 3-methylbenzothiazolium iodide was added and the mixture was heated for 15 minutes at 50° C. A 0.73 molar aqueous solution of sodium salt of benzotriazole was added and the mixture was heated for 10 minutes at 50° C. The mixture was cooled to 40° C. and its pH was adjusted to 5.0 with 2.5N sulfuric acid. A 18% aqueous solution of Compound A-1 was added and the mixture was heated for 10 minutes at 40° C. A 4% active aqueous solution of Zonyl® FS-300 surfactant was finally added and the mixture was hold at 40° C.

Component D: A portion of the ultra-thin tabular grain silver halide emulsion prepared as described above was placed in a beaker and melted at 40° C.

Component E: A mixture of 1,3-dimethylurea, succinimide, and xylitol was dissolved in water by heating at 50° C. Dispersions of D-1-B and S-1-B described above were added to the above solution at room temperature.

Component F: A portion of hydrated gelatin (25% deionized lime-processed gelatin/75% water) was placed in a beaker and heated to 40° C. for 10 minutes to melt. The melt was added to 1,3-dimethylurea, a 5% aqueous solution of boric acid, 8.05% of 6.5 μm polystyrene beads (PS Beads) containing 9.0% gelatin and a 4% active aqueous solution of Zonyl® FS-300 surfactant.

Component G: A 1.7% aqueous solution of Compound VS-1 was prepared by dissolving Compound VS-1 in water at 50° C.

Coating and Evaluation of Photothermographic Materials:

Components A and B were mixed immediately before coating to form the conductive underlayer formulation, components C, D, and E were mixed immediately before coating to form a photothermographic emulsion formulation, and components F and G were mixed immediately before coating to form a overcoat formulation.

The conductive underlayer formulation was coated onto a 7 mil (178 μm) transparent, blue-tinted poly(ethylene terephthalate) film support using stainless steel Mayer bar RDS04. The photothermographic formulation and the overcoat formulation were simultaneously coated as a dual-layer over the conductive underlayer using a conventional automated dual-knife coating machine. The conductive underlayer was dried at 113° F. (48.9° C.) for 11 minutes to achieve the dry coating weights shown in TABLE IV.

After 24 hours, the photothermographic and overcoat formulations were simultaneously dual-coated over the conductive underlayer using a conventional automated dual-knife coating machine and dried at 113° F. (48.9° C.) for 11 minutes. The coating gaps for the photothermographic and overcoat layers were adjusted to achieve the dry coating weights shown in TABLE V. Comparative Sample 2-1-C contained no underlayer. It served as a control.

TABLE IV

| | Gelatin:Metal | Metal Oxide | | Gelatin | | Zonyl ® FS-300 Surfactant | | Compound VS-1 | |
|---|---|---|---|---|---|---|---|---|---|
| Sample | Oxide Ratio | (mg/ft$^2$) | [mg/m$^2$] | (mg/ft$^2$) | [mg/m$^2$] | (mg/ft$^2$) | [mg/m$^2$] | (mg/ft$^2$) | [mg/m$^2$] |
| 2-1-C | — | — | | — | | — | | — | |
| 2-2 | 1:2 | 42 | 452 | 21 | 226 | 1.35 | 14.5 | 0.41 | 4.41 |
| 2-3 | 1:2 | 18 | 194 | 9 | 97 | 1.15 | 12.4 | 0.18 | 1.94 |
| 2-4 | 1:3 | 48 | 516 | 16 | 172 | 1.02 | 11.0 | 0.32 | 3.44 |

TABLE IV-continued

| Sample | Gelatin:Metal Oxide Ratio | Metal Oxide (mg/ft$^2$) | Metal Oxide [mg/m$^2$] | Gelatin (mg/ft$^2$) | Gelatin [mg/m$^2$] | Zonyl ® FS-300 Surfactant (mg/ft$^2$) | Zonyl ® FS-300 Surfactant [mg/m$^2$] | Compound VS-1 (mg/ft$^2$) | Compound VS-1 [mg/m$^2$] |
|---|---|---|---|---|---|---|---|---|---|
| 2-5 | 1:3 | 25 | 269 | 8.3 | 89 | 1.07 | 11.5 | 0.16 | 1.72 |
| 2-6 | 1:4 | 49 | 527 | 12.3 | 132 | 0.78 | 8.39 | 0.23 | 2.47 |
| 2-7 | 1:4 | 28 | 301 | 7 | 75 | 0.89 | 9.58 | 0.13 | 1.40 |

TABLE IV

| Component | Compound | Dry Coating Weight (g/m$^2$) |
|---|---|---|
| | Conductive Underlayer | |
| A | CELNAX ® CX-Z300H | See Table V |
| A | Gelatin | See Table V |
| A | Zonyl ® FS-300 surfactant | See Table V |
| A | Compound VS-1 | See Table V |
| | Photothermographic Layer | |
| C | Silver (from AgBZT/Ag T-1) | 1.44 |
| C | Lime processed gelatin | 2.02 |
| C | 3-Methylbenzothiazolium Iodide | 0.072 |
| C | Sodium benzotriazole | 0.085 |
| C | Compound A-1 | 0.073 |
| C | Zonyl ® FS-300 surfactant | 0.021 |
| D | Silver (from AgBrI emulsion) | 0.25 |
| E | Succinimide | 0.18 |
| E | 1,3-Dimethylurea (1,3-DMU) | 0.29 |
| E | Xylitol | 0.47 |
| E | Compound S-1-B | 0.035 |
| E | Compound D-1-B | 3.41 |
| | Overcoat Layer | |
| F | De-ionized lime-processed gelatin | 1.49 |
| F | Boric acid | 0.056 |
| F | 1,3-Dimethylurea (1,3-DMU) | 0.23 |
| F | Zonyl ® FS-300 surfactant | 0.034 |
| F | 6.5 μm Polystyrene Beads | 0.091 |
| G | Compound VS-1 | 0.085 |

The resulting photothermographic films were imagewise exposed as described in Example 1. Samples were equilibrated at 70.3° F. (21.3° C.) and 29% relative humidity for 24 hours prior to testing. The resistivity was measured as described above.

The results, shown below in TABLE VI, demonstrate improved conductivity with the addition of a conductive underlayer. Increased amounts of metal oxide particles resulted in further increased conductivity. Little if any effect on the initial Dmin, Dmax, or Speed-2 with the addition of the conductive underlayer was seen. Any differences appear to be due to higher coating weights of the photothermographic layer as compared to the control rather than interaction from the conductive underlayer.

TABLE VI

| Sample | Dmin | Dmax | Speed-2 | log WER (ohm/sq) |
|---|---|---|---|---|
| 2-1-C | 0.288 | 2.559 | 5.531 | 13.1 |
| 2-2 | 0.306 | 2.660 | 5.550 | 9.5 |
| 2-3 | 0.312 | 2.540 | 5.502 | 10.9 |
| 2-4 | 0.315 | 2.694 | 5.527 | 9.0 |
| 2-5 | 0.302 | 2.525 | 5.545 | 9.8 |

TABLE VI-continued

| Sample | Dmin | Dmax | Speed-2 | log WER (ohm/sq) |
|---|---|---|---|---|
| 2-6 | 0.313 | 2.604 | 5.501 | 8.7 |
| 2-7 | 0.316 | 3.084 | 5.650 | 9.5 |

EXAMPLE 3

Evaluation of Zinc Antimonate Underlayer with an Aqueous Photothermographic Silver Layer and a Gelatin Overcoat Preparation of Photothermographic Materials:

Component A: A portion of hydrated gelatin (5% de-ionized lime-processed gelatin/95% water) was placed in a beaker and melted by heating at 40° C. for 10 minutes. The melt was added to a 30% aqueous solution of CELNAX® CX-Z300H metal oxide dispersion. To this solution was added a 4% active aqueous solution of Zonyl® FS-300 surfactant and an amount of de-ionized water that resulted in an overall 3.5% solids.

Component B: A 1.7% aqueous solution of Compound VS-1 was prepared by dissolving Compound VS-1 in water at 50° C.

Component C: The AgBZT/AgT-1 co-precipitated emulsion prepared above and hydrated gelatin (35% gelatin/65% water) were placed in a beaker and heated to 50° C. for 15 minutes. A 5% aqueous solution of 3-methylbenzothiazolium iodide was added and the mixture was heated for 15 minutes at 50° C. A 0.73 molar aqueous solution of sodium salt of benzotriazole was added and the mixture was heated for 10 minutes at 50° C. The mixture was cooled to 40° C. and its pH was adjusted to 5.0 with 2.5N sulfuric acid. A 18% aqueous solution of Compound A-1 was added and the mixture was heated for 10 minutes at 40° C. A 4% active aqueous solution of Zonyl® FS-300 surfactant was finally added and the mixture was held at 40° C.

Component D: A portion of the ultra-thin tabular grain silver halide emulsion prepared as described above was placed in a beaker and melted at 40° C. To 76 g of this emulsion was added 0.863 g of a 2.19% aqueous solution of Compound S-3 and stirred for 2 hours.

Component E: A mixture of 1,3-dimethylurea, succinimide, and xylitol was dissolved in water by heating at 50° C. Dispersions of D-1-B and S-1-B described above were added to the above solution at room temperature.

Component F: A portion of hydrated gelatin (30.9% de-ionized lime-processed gelatin/69.1% water) was placed in a beaker and heated to 40° C. for 10 minutes to melt. The melt was added to 1,3-dimethylurea, a 5% aqueous solution of boric acid, 8.05% of 6.5 μm polystyrene beads (PS Beads) containing 9.0% gelatin, 2.67% Compound S-2 solution, and a 4% active aqueous solution of Zonyl® FS-300 surfactant.

Component G: A 1.7% aqueous solution of Compound VS-1 was prepared by dissolving Compound VS-1 in water at 50° C.

Coating and Evaluation of Photothermographic Materials:

Components A and B were mixed immediately before coating to form the conductive underlayer formulation, components C, D, and E were mixed immediately before coating to form a photothermographic emulsion formulation, and components F and G were mixed immediately before coating to form a overcoat formulation.

The conductive underlayer formulations were coated onto a 7 mil (178 μm) transparent, blue-tinted poly(ethylene terephthalate) film support using stainless steel Mayer bars RDS03 to RDS06 and dried at 113° F. (48.9° C.) for 11 minutes. The conductive underlayer formulation was coated to achieve the dry coating weights shown in TABLE VII.

After 24 hours, the photothermographic and overcoat formulations were simultaneously dual-knife coated over the underlayer using a conventional automated dual-knife coating machine and dried at 113° F. (48.9° C.) for 11 minutes. The coating gaps for the photothermographic and overcoat layers were adjusted to achieve the dry coating weights shown in TABLE VIII. Comparative Sample 3-1-C contained no underlayer. It served as a control.

TABLE VII

| Sample | Mayer Bar | Gelatin:Metal Oxide Ratio | Metal Oxide (mg/ft$^2$) | Metal Oxide [mg/m$^2$] | Gelatin (mg/ft$^2$) | Gelatin [mg/m$^2$] | Zonyl ® FS-300 Surfactant (mg/ft$^2$) | Zonyl ® FS-300 Surfactant [mg/m$^2$] | Compound VS-1 (mg/ft$^2$) | Compound VS-1 [mg/m$^2$] |
|---|---|---|---|---|---|---|---|---|---|---|
| 3-1-C | — | — | — | | — | | — | | — | |
| 3-2 | RDS03 | 1:2 | 18 | 194 | 9 | 96.8 | 1.15 | 12.4 | 0.18 | 1.94 |
| 3-3 | RDS04 | 1:2 | 23 | 247 | 11.5 | 124 | 1.47 | 15.8 | 0.23 | 2.47 |
| 3-4 | RDS05 | 1:2 | 28 | 301 | 14 | 151 | 1.79 | 19.3 | 0.27 | 2.91 |
| 3-5 | RDS06 | 1:2 | 31 | 334 | 15.5 | 167 | 1.99 | 21.4 | 0.30 | 3.23 |
| 3-6 | RDS03 | 1:3 | 20 | 215 | 6.7 | 72.1 | 0.85 | 9.15 | 0.13 | 1.40 |
| 3-7 | RDS04 | 1:3 | 22 | 237 | 7.3 | 78.3 | 0.94 | 10.1 | 0.14 | 1.51 |
| 3-8 | RDS05 | 1:3 | 33 | 355 | 11.0 | 118 | 1.41 | 15.2 | 0.22 | 2.37 |
| 3-9 | RDS03 | 1:4 | 21 | 226 | 5.2 | 56.0 | 0.67 | 7.21 | 0.10 | 1.08 |
| 3-10 | RDS04 | 1:4 | 25 | 269 | 6.3 | 67.8 | 0.80 | 8.61 | 0.12 | 1.29 |
| 3-11 | RDS05 | 1:4 | 36 | 387 | 9.0 | 96.8 | 1.15 | 12.4 | 0.17 | 1.83 |

TABLE VIII

| Component | Compound | Dry Coating Weight (g/m$^2$) |
|---|---|---|
| | Conductive Underlayer | |
| A | CELNAX ® CX-Z300H | See Table VIII |
| A | Gelatin | See Table VIII |
| A | Zonyl ® FS-300 surfactant | See Table VIII |
| A | Compound VS-1 | See Table VIII |
| | Photothermographic Layer | |
| C | Silver (from AgBZT/Ag T-1) | 1.38 |
| C | Lime processed gelatin | 1.94 |
| C | 3-Methylbenzothiazolium Iodide | 0.069 |
| C | Sodium benzotriazole | 0.081 |
| C | Compound A-1 | 0.070 |
| C | Zonyl ® FS-300 surfactant | 0.020 |
| D | Silver (from AgBrI emulsion) | 0.24 |
| D | Compound S-3 | 0.00028 |
| E | Succinimide | 0.17 |
| E | 1,3-Dimethylurea (1,3-DMU) | 0.28 |

TABLE VIII-continued

| Component | Compound | Dry Coating Weight (g/m$^2$) |
|---|---|---|
| E | Xylitol | 0.45 |
| E | Compound S-1-B | 0.034 |
| E | Compound D-1-B | 3.37 |
| | Overcoat Layer | |
| F | De-ionized lime-processed gelatin | 1.49 |
| F | Boric acid | 0.056 |
| F | 1,3-Dimethylurea (1,3-DMU) | 0.18 |
| F | Zonyl ® FS-300 surfactant | 0.034 |
| F | Compound S-2 | 0.030 |
| F | 6.5 μm Polystyrene Beads | 0.091 |
| G | Compound VS-1 | 0.085 |

The resulting photothermographic films were imagewise exposed as described in Example 1. The conductivity was measured as described in Example 1. Samples were equilibrated at 69.9° F. (21.1° C.) and 21% relative humidity for 24 hours prior to testing. The results in TABLE IX show little to no effect on the initial Dmin, Dmax, or Speed-2 with the addition of the conductive underlayer. Any changes were due to higher coating weights of the photothermographic layer as compared to the control than interaction from the conductive underlayer. The conductivity improved with the addition of the conductive underlayer and increased amounts of metal oxide particles.

TABLE IX

| Sample | $D_{min}$ | $D_{max}$ | Speed-2 | log WER (ohm/sq) |
|---|---|---|---|---|
| 3-1-C | 0.281 | 2.158 | 5.436 | 13.8 |
| 3-2 | 0.302 | 2.377 | 5.415 | 11.0 |
| 3-3 | 0.290 | 2.387 | 5.481 | 10.3 |
| 3-4 | 0.315 | 2.834 | 5.551 | 10.1 |
| 3-5 | 0.293 | 2.674 | 5.581 | 10.0 |
| 3-6 | 0.294 | 2.678 | 5.460 | 10.2 |
| 3-7 | 0.287 | 2.506 | 5.456 | 9.6 |
| 3-8 | 0.295 | 2.483 | 5.486 | 9.6 |
| 3-9 | 0.303 | 2.555 | 5.562 | 9.9 |
| 3-10 | 0.292 | 2.747 | 5.516 | 9.7 |
| 3-11 | 0.294 | 2.518 | 5.438 | 9.5 |

EXAMPLE 4

Evaluation of Zinc Antimonate Layer Containing Cloisite $Na^+$ Clay

Preparation of Conductive Layer:

Component A: A portion of hydrated gelatin containing Cloisite $Na^+$ clay (5% de-ionized lime-processed gelatin/95% water and various amounts of 0.5% clay to form a 1%, 3%, 5% or 10% clay to gel solution) was placed in a beaker melted by heating at 40° C. for 10 minutes. The 0.5% clay solution was mixed for 2 hours before the addition to the melted gelatin. The resulting 1%, 3% 5% and 10% clay to gelatin solutions were then mixed for an additional 2 hours at 40° C. before addition to a 30% aqueous solution of CELNAX®CX-Z 300H metal oxide dispersion. To this solution was added a 4% active aqueous solution of Zonyl® FS-300 surfactant and an amount of de-ionized water that results in an overall 3.5% solids.

Component B: A 1.7% aqueous solution of Compound VS-1 was prepared by dissolving Compound VS-1 in water at 50° C.

Coating and Evaluation of Conductive Materials:

Components A and B were mixed immediately before coating to form the conductive underlayer formulation. The conductive underlayer formulation was coated onto a 7 mil (178 μm) transparent, blue-tinted poly(ethylene terephthalate) film support using stainless steel Mayer bar RDS04 and dried at 113° F. (48.9° C.) for 11 minutes. Comparative Samples 4-1-C and 4-6-C contained no clay in the conductive layer. They served as controls. The conductive metal oxide particles and clay were coated at the dry coating weights shown in TABLE X.

TABLE X

| Sample | Gelatin:Metal Oxide Ratio | % Clay to Gelatin | Metal Oxide (mg/ft²) | Metal Oxide [mg/m²] | Gelatin (mg/ft²) | Gelatin [mg/m²] | Clay (mg/ft²) | Clay [mg/m²] | Zonyl ® FS-300 Surfactant (mg/ft²) | Zonyl ® FS-300 Surfactant [mg/m²] | Compound VS-1 (mg/ft²) | Compound VS-1 [mg/m²] |
|---|---|---|---|---|---|---|---|---|---|---|---|---|
| 4-1-C | 1:2 | 0 | 21 | 226 | 10.6 | 114 | 0 | 0 | 1.35 | 14.5 | 0.21 | 2.26 |
| 4-2 | 1:2 | 1 | 21 | 226 | 10.6 | 114 | 0.11 | 1.18 | 1.35 | 14.5 | 0.21 | 2.26 |
| 4-3 | 1:2 | 3 | 19 | 204 | 9.6 | 103 | 0.29 | 3.12 | 1.22 | 13.1 | 0.19 | 2.04 |
| 4-4 | 1:2 | 5 | 23 | 247 | 11.6 | 125 | 0.58 | 6.24 | 1.47 | 15.8 | 0.23 | 2.47 |
| 4-5 | 1:2 | 10 | 21 | 226 | 10.6 | 114 | 1.06 | 11.4 | 1.35 | 14.5 | 0.21 | 2.26 |
| 4-6 | 1:3 | 0 | 23 | 347 | 7.7 | 82.9 | 0 | 0 | 0.98 | 10.5 | 0.15 | 1.61 |
| 4-7 | 1:3 | 1 | 21 | 226 | 7.0 | 75.3 | 0.07 | 0.75 | 0.90 | 9.68 | 0.14 | 1.50 |
| 4-8 | 1:3 | 3 | 23 | 347 | 7.7 | 82.9 | 0.23 | 2.47 | 0.98 | 10.54 | 0.15 | 1.61 |
| 4-9 | 1:3 | 5 | 22 | 337 | 7.4 | 79.6 | 0.37 | 3.98 | 0.94 | 10.11 | 0.14 | 1.50 |
| 4-10 | 1:3 | 10 | 24 | 258 | 8.0 | 86.1 | 0.80 | 8.61 | 1.02 | 11.0 | 0.16 | 1.72 |

The conductivity of these samples was measured using the water electrode resistivity test method or WER as described above. Samples were equilibrated at 70.5° F. (21.4° C.) and 22% relative humidity for 24 hours prior to testing.

The results, shown below in TABLE XI, demonstrate that conductivity improved with the addition of clay to the conductive underlayer. Increased amounts of metal oxide particles provided further improvement.

TABLE XI

| Sample | Log WER (ohm/sq) |
|---|---|
| 4-1-C | 9.4 |
| 4-2 | 9.4 |
| 4-3 | 9.0 |
| 4-4 | 8.9 |
| 4-5 | 9.2 |
| 4-6 | 9.1 |
| 4-7 | 9.1 |
| 4-8 | 9.0 |
| 4-9 | 8.5 |
| 4-10 | 8.5 |

EXAMPLE 5

Evaluation of Zinc Antimonate or Zinc Antimonate/Clay Underlayer with an Aqueous Photothermographic Silver Layer and a Gelatin Overcoat Preparation of Photothermographic Materials:

Component A: A portion of hydrated gelatin containing Cloisite $Na^+$ clay (5% de-ionized lime-processed gelatin/95% water and various amounts of a 0.5% aqueous dispersion of clay to form a 5% or 10% clay to gel solution) was placed in a beaker and melted by heating at 40° C. for 10 minutes. The 0.5% clay dispersion was mixed for 2 hours before the addition to the melted gelatin. The resulting 5% or 10% clay to gelatin solutions were then mixed for an additional 2 hours at 40° C. before addition to a 30% aqueous solution of CELNAX® CX-Z300H metal oxide dispersion. To this was added an aqueous solution of 4% Zonyl® FS-300 surfactant and an amount of de-ionized water that resulted in 3.5% overall solids.

Components B, C, D, E, F, and G were prepared as described in Example 3.

Coating and Evaluation of Photothermographic Materials:

The Components were mixed and coated as described in Example 3. The coating gaps for each layer were adjusted to achieve the dry coating weights for the photothermographic and overcoat layers shown in TABLE XII. Comparative Sample 5-1-C contained no underlayer. It served as a control. The conductive underlayer was coated at the dry coating weights shown in TABLE XIII.

TABLE XII

| Component | Compound | Dry Coating Weight (g/m$^2$) |
|---|---|---|
| | Conductive Underlayer | |
| A | CELNAX ® CX-Z300H | See Table XIII |
| A | Gelatin | See Table XIII |
| A | Clay | See Table XIII |
| A | Zonyl ® FS-300 surfactant | See Table XIII |
| B | Compound VS-1 | See Table XIII |
| | Photothermographic Layer | |
| C | Silver (from AgBZT/Ag T-1) | 1.49 |
| C | Lime processed gelatin | 2.10 |
| C | 3-Methylbenzothiazolium Iodide | 0.075 |
| C | Sodium benzotriazole | 0.088 |
| C | Compound A-1 | 0.076 |
| C | Zonyl ® FS-300 surfactant | 0.022 |
| D | Silver (from AgBrI emulsion) | 0.26 |
| E | Succinimide | 0.18 |
| E | 1,3-Dimethylurea (1,3-DMU) | 0.30 |
| E | Xylitol | 0.49 |
| E | Compound S-1-B | 0.037 |
| E | Compound D-1-B | 3.64 |
| | Overcoat Layer | |
| F | De-ionized lime-processed gelatin | 1.49 |
| F | Boric acid | 0.056 |
| F | 1,3-Dimethylurea (1,3-DMU) | 0.18 |
| F | Zonyl ® FS-300 surfactant | 0.034 |
| F | Compound S-2 | 0.030 |
| F | 6.5 μm Polystyrene Beads | 0.091 |
| G | Compound VS-1 | 0.085 |

TABLE XIII

| | Gelatin:Metal | % Clay | Metal Oxide | | Gelatin | | Clay | | Zonyl ® FS-300 Surfactant | | Compound VS-1 | |
|---|---|---|---|---|---|---|---|---|---|---|---|---|
| Sample | Oxide Ratio | to Gelatin | (mg/ft$^2$) | [mg/m$^2$] | (mg/ft$^2$) | [mg/m$^2$] | (mg/ft$^2$) | [mg/m$^2$] | (mg/ft$^2$) | [mg/m$^2$] | (mg/ft$^2$) | [mg/m$^2$] |
| 5-1-C | — | — | — | | — | | — | | — | | — | |
| 5-2 | 1:4 | 0 | 28 | 301 | 7.0 | 75.3 | 0 | 0 | 0.89 | 9.58 | 0.13 | 1.40 |
| 5-3 | 1:4 | 5 | 28 | 301 | 7.0 | 75.3 | 0.35 | 3.77 | 0.89 | 9.58 | 0.13 | 1.40 |
| 5-4 | 1:4 | 10 | 28 | 301 | 7.0 | 75.3 | 0.70 | 7.53 | 0.89 | 9.58 | 0.13 | 1.40 |

The resulting photothermographic films were imagewise exposed as described in Example 1. The conductivity was measured as described in Example 1. Samples were equilibrated at 70.5° F. (21.4° C.) and 25% relative humidity for 24 hours prior to testing.

The results, shown below in TABLE XIV, demonstrate improved conductivity with the addition of clay to the conductive underlayer beyond that achieved with addition of only metal oxide particles to the conductive underlayer. Little if any effect on the initial Dmin, Dmax, or Speed-2 with the addition of metal oxide particles was seen. Any differences appear to be due to higher coating weights of the photothermographic layer as compared to the control than interaction from the conductive underlayer.

TABLE XIV

| Sample | Dmin | Dmax | Speed-2 | log WER (ohm/sq) |
|---|---|---|---|---|
| 5-1-C | 0.291 | 2.698 | 5.520 | 14.1 |
| 5-2 | 0.317 | 2.945 | 5.588 | 9.8 |
| 5-3 | 0.308 | 2.799 | 5.555 | 9.4 |
| 5-4 | 0.279 | 2.367 | 5.399 | 9.6 |

EXAMPLE 6

Evaluation of a Zinc Antimonate Underlayer with an Aqueous Photothermographic Layer and a Gelatin Overcoat Containing a Lithium Salt Preparation of Photothermographic Materials:

Component A: A portion of hydrated gelatin (5% de-ionized lime-processed gelatin/95% water) was placed in a beaker and melted by heating to 40° C. for 10. The melt was added to a 30% aqueous solution of CELNAX® CXZ300H metal oxide dispersion and a 4% active aqueous solution of ZONYL® FS-300 surfactant.

Component B: A 1.7% aqueous solution of Compound VS-1 was prepared by dissolving Compound VS-1 in water at 50° C.

Component C: The AgBZT/AgT-1 co-precipitated emulsion prepared above and hydrated gelatin (35% gelatin/65% water) were placed in a beaker and melted by heating to 50° C. for 15 minutes. A 5% aqueous solution of 3-methylbenzothiazolium iodide was added and the mixture was heated for 15 minutes at 50° C. A 0.73 molar aqueous solution of sodium salt of benzotriazole was added and the mixture was heated for 10 minutes at 50° C. The mixture was cooled to 40° C. and its pH was adjusted to 5.0 with 2.5N sulfuric acid. An 18% aqueous solution of Compound A-1 was added and the mixture was heated for 10 minutes at 40° C. A 4% active aqueous solution of ZONYL® FS-300 surfactant was finally added and the mixture was held at 40° C.

Component D: A portion of the ultra-thin tabular grain silver halide emulsion prepared as described above was placed in a beaker and melted at by heating at 40° C.

Component E: A mixture of 1,3-dimethylurea, succinimide, and xylitol was dissolved in water by heating at 50° C. Dispersions of D-1-A and S-1-A prepared above were added to the above solution at room temperature.

Component F: Hydrated gelatin (42 g, 25% de-ionized lime-processed gelatin/75% water) was placed in a beaker and melted by heating to 40° C. for 10 minutes. The melt was added to 6.7 g of a mixture prepared by mixing 1.6 g of 1,3-dimethylurea, 8 g of a 5% aqueous solution of boric acid, 10 g of a dispersion of 8.05% of 6.5 μm polystyrene beads (PS Beads) containing 9% gelatin, and 6 g of 4% active aqueous solution of ZONYL® FS-300 surfactant.

Component G: A 1.7% aqueous solution of Compound VS-1 was prepared by dissolving VS-1 in water at 50° C.

Component H: A 12.5% aqueous solutions of Compound LS-2 was prepared by dissolving LS-2 in water.

Coating and Evaluation of Photothermographic Materials:

Components A and B were mixed immediately before coating to form the conductive underlayer formulation. Components C, D, and E were mixed immediately before coating to form a photothermographic emulsion formulation, and components F, G, and H were mixed immediately before coating to form a overcoat formulation. The conductive underlayer formulation was coated onto a 7 mil (178 μm) transparent, blue-tinted poly(ethylene terephthalate) film support and dried at 113° F. (48.9° C.) for 11 minutes. The conductive underlayer formulation was coated at the dry coating weights shown in TABLES XV and XVI.

After 24 hours, the photothermographic and overcoat formulations were simultaneously dual layer coated over the conductive underlayer using a conventional automated dual-knife coating machine and dried at 113° F. (48.9° C.) for 11 minutes. The coating gaps for each layer were adjusted to achieve the dry coating weights for the photothermographic and overcoat layers shown in TABLES XV and XVI. Comparative Samples 6-1-C and 6-3-C contained a conductive underlayer with no lithium salt in the overcoat layer. They served as controls. The lithium salts in the overcoat layer were coated at the dry coating weights shown in TABLE XVII.

TABLE XV

| Component | Compound | Dry Coating Weight ($g/m^2$) |
|---|---|---|
| | Conductive Underlayer | |
| A | CELNAX ® CX-Z300H | See Table XVI |
| A | Gelatin | See Table XVI |
| A | ZONYL ® FS-300 surfactant | See Table XVI |
| B | Compound VS-1 | See Table XVI |
| | Photothermographic Layer | |
| C | Silver (from AgBZT/Ag T-1) | 1.32 |
| C | Lime processed gelatin | 1.85 |
| C | 3-Methylbenzothiazolium Iodide | 0.066 |
| C | Sodium benzotriazole | 0.078 |
| C | Compound A-1 | 0.067 |
| C | ZONYL ® FS-300 surfactant | 0.019 |
| D | Silver (from AgBrI emulsion) | 0.23 |
| E | Succinimide | 0.17 |
| E | 1,3-Dimethylurea (1,3-DMU) | 0.27 |
| E | Xylitol | 0.43 |
| E | Compound S-1-A | 0.032 |
| E | Compound D-1-A | 3.38 |
| | Overcoat Layer | |
| F | De-ionized lime-processed gelatin | See TABLE XVII |
| F | Boric acid | See TABLE XVII |
| F | 1,3-Dimethylurea (1,3-DMU) | See TABLE XVII |
| F | ZONYL ® FS-300 surfactant | See TABLE XVII |
| F | 6.5 μm polystyrene beads | See TABLE XVII |
| G | Compound VS-1 | See TABLE XVII |
| H | Compound LS-2 | See TABLE XVII |

TABLE XVII

Overcoat Coating Weights

| Sample | Gelatin ($g/m^2$) | Boric acid ($g/m^2$) | 1,3-DMU ($g/m^2$) | Zonyl ® FS-300 Surfactant ($g/m^2$) | Compound VS-1 ($g/m^2$) | PS Beads ($g/m^2$) | Compound LS-2 ($g/m^2$) |
|---|---|---|---|---|---|---|---|
| 6-1-C | 1.63 | 0.062 | 0.25 | 0.037 | 0.093 | 0 | 0 |
| 6-2 | 1.63 | 0.062 | 0.25 | 0.037 | 0.093 | 0.010 | 0.099 |
| 6-3-C | 1.63 | 0.062 | 0.25 | 0.037 | 0.093 | 0 | 0 |
| 6-4 | 1.63 | 0.062 | 0.25 | 0.037 | 0.093 | 0.010 | 0.049 |

TABLE XVI

Underlayer Coating Weights

| Sample | Gelatin:Metal Oxide Ratio | Metal Oxide ($mg/ft^2$) | Metal Oxide [$mg/m^2$] | Gelatin ($mg/ft^2$) | Gelatin [$mg/m^2$] | Zonyl ® FS-300 Surfactant ($mg/ft^2$) | Zonyl ® FS-300 Surfactant [$mg/m^2$] | Compound VS-1 ($mg/ft^2$) | Compound VS-1 [$mg/m^2$] |
|---|---|---|---|---|---|---|---|---|---|
| 6-1-C | 1:2 | 37 | 398 | 18.6 | 200 | 1.19 | 12.8 | 0.36 | 3.9 |
| 6-2 | 1:2 | 37 | 398 | 18.6 | 200 | 1.19 | 12.8 | 0.36 | 3.9 |
| 6-3-C | 1:4 | 28 | 301 | 7 | 75 | 0.45 | 4.8. | 0.13 | 1.4 |
| 6-4 | 1:4 | 28 | 301 | 7 | 75 | 0.45 | 4.8 | 0.13 | 1.4 |

Natural Age Keeping:

Freshly prepared samples were imaged and developed as described in Example 1

Non-imaged samples were stored in a black polyethylene bag for 3 months at ambient room temperature and relative humidity to determine their Natural Age Keeping properties. The samples were then imaged and developed as described in Example 1 and their sensitometry was compared with that of the freshly prepared samples.

The sensitometric results, shown below in TABLE XVIII, demonstrate improved Natural Age Keeping with the incorporation of lithium salts. This is evidenced by the smaller increase in Dmin (ΔDmin) of the photothermographic materials incorporating lithium salt compound LS-2 compared to that of the similarly prepared control photothermographic material (Sample 2-1-C) containing no lithium compound. All samples showed good Dmax, Dmin, and Speed-2.

TABLE XVIII

| Sample | Dmin | Dmax | Speed-2 | ΔDmin |
|---|---|---|---|---|
| 6-1-C | 0.288 | 2.400 | 5.526 | +0.131 |
| 6-2 | 0.310 | 2.667 | 5.569 | +0.047 |
| 6-3 | 0.291 | 2.740 | 5.561 | +0.523 |
| 6-4 | 0.310 | 3.068 | 5.738 | −0.009 |

EXAMPLE 7

Evaluation of Zinc Antimonate-Containing Lithium Salt Underlayer with an Aqueous Photothermographic Silver Layer and Gelatin Overcoat Preparation of Photothermographic Materials:

Component A: A portion of hydrated gelatin (5% de-ionized lime-processed gelatin/95% water) was placed in a beaker and melted by heating to 40° C. for 10 minutes. The melt was added to a 30% aqueous solution of CELNAX® CX-Z300H metal oxide dispersion, a 25% aqueous solution of Compound LS-2, and a 4% active aqueous solution of ZONYL® FS-300 surfactant.

Component B: A 1.7% aqueous solution of Compound VS-1 was prepared by dissolving Compound VS-1 in water at 50° C.

Components C, D, E, F, and G: These components were prepared as described in Example 2.

Coating and Evaluation of Photothermographic Materials:

Components A and B were mixed immediately before coating to form a conductive underlayer containing a conductive metal oxide and a lithium salt. Components C, D, and E were mixed immediately before coating to form a photothermographic emulsion formulation, and components F and G were mixed immediately before coating to form a overcoat formulation. The conductive metal oxide/lithium salt underlayer formulation, the photothermographic formulation, and the overcoat formulation were coated as described in Example 6. The conductive metal oxide/lithium salt underlayers were coated at the dry coating weights shown in TABLES XIX and XX. The coating gaps were adjusted to achieve the dry coating weights for the photothermographic and overcoat layers shown in TABLE XIX. Comparative Samples 7-1-C, 7-4-C, and 7-6-C contained a conductive underlayer with no lithium salts. They served as controls.

TABLE XIX

| Component | Compound | Dry Coating Weight (g/m$^2$) |
|---|---|---|
| | Conductive Underlayer | |
| A | CELNAX ® CX-Z300H | See Table XX |
| A | Gelatin | See Table XX |
| A | ZONYL ® FS-300 surfactant | See Table XX |
| A | Compound LS-2 | See Table XX |
| | Photothermographic Layer | |
| C | Silver (from AgBZT/Ag T-1) | 1.44 |
| C | Lime processed gelatin | 2.02 |
| C | 3-Methylbenzothiazolium Iodide | 0.072 |
| C | Sodium benzotriazole | 0.085 |
| C | Compound A-1 | 0.073 |
| C | ZONYL ® FS-300 surfactant | 0.021 |
| D | Silver (from AgBrI emulsion) | 0.25 |
| E | Succinimide | 0.18 |
| E | 1,3-Dimethylurea (1,3-DMU) | 0.29 |
| E | Xylitol | 0.47 |
| E | Compound S-1-A | 0.035 |
| E | Compound D-1-A | 3.41 |
| | Overcoat Layer | |
| F | De-ionized lime-processed gelatin | 1.63 |
| F | Boric acid | 0.062 |
| F | 1,3-Dimethylurea (1,3-DMU) | 0.25 |
| F | 6.5 μm polystyrene beads | 0.010 |
| F | ZONYL ® FS-300 surfactant | 0.037 |
| G | Compound VS-1 | 0.093 |

TABLE XX

| | | Underlayer Coating Weights | | | | | | | | | |
|---|---|---|---|---|---|---|---|---|---|---|---|
| | Gelatin:Metal | Metal Oxide | | Gelatin | | LS-2 | | Zonyl ® FS-300 Surfactant | | Compound VS-1 | |
| Sample | Oxide Ratio | (mg/ft$^2$) | [mg/m$^2$] | (mg/ft$^2$) | [mg/m$^2$] | (mg/ft$^2$) | [mg/m$^2$] | (mg/ft$^2$) | [mg/m$^2$] | (mg/ft$^2$) | [mg/m$^2$] |
| 7-1-C | 1:2 | 37 | 398 | 18.6 | 200 | None | | 1.19 | 12.8 | 0.36 | 3.9 |
| 7-2 | 1:2 | 37 | 398 | 18.6 | 200 | 14.8 | 159 | 1.19 | 12.8 | 0.36 | 3.9 |
| 7-3 | 1:2 | 37 | 398 | 18.6 | 200 | 7.4 | 79.6 | 1.19 | 12.8 | 0.36 | 3.9 |
| 7-4-C | 1:3 | 47 | 506 | 15.6 | 168 | None | | 1.00 | 10.8 | 0.31 | 3.3 |

TABLE XX-continued

| | | Underlayer Coating Weights | | | | | | | | | |
|---|---|---|---|---|---|---|---|---|---|---|---|
| | Gelatin:Metal | Metal Oxide | | Gelatin | | LS-2 | | Zonyl ® FS-300 Surfactant | | Compound VS-1 | |
| Sample | Oxide Ratio | (mg/ft$^2$) | [mg/m$^2$] | (mg/ft$^2$) | [mg/m$^2$] | (mg/ft$^2$) | [mg/m$^2$] | (mg/ft$^2$) | [mg/m$^2$] | (mg/ft$^2$) | [mg/m$^2$] |
| 7-5 | 1:3 | 47 | 506 | 15.6 | 168 | 15.7 | 169 | 1.00 | 10.8 | 0.31 | 3.3 |
| 7-6-C | 1:4 | 28 | 301 | 7 | 75 | None | | 0.45 | 4.8 | 0.13 | 1.4 |
| 7-7 | 1:4 | 28 | 301 | 7 | 75 | 8.2 | 88 | 0.45 | 4.8 | 0.13 | 1.4 |

The resulting photothermographic films were evaluated for Natural Age keeping as described in Example 6. The sensitometric results, shown below in TABLE XXI, demonstrate improved Natural Age Keeping with the incorporation of lithium compounds. This is evidenced by the smaller increase in Dmin (ΔDmin) of the photothermographic materials incorporating lithium salt compound LS-2 compared to that of the similarly prepared control photothermographic materials containing no lithium compounds. In addition, little if any effect on the initial Dmin, Dmax, or Speed-2 with the addition of the lithium compounds was seen. Any differences appear to be due to higher coating weights of the photothermographic layer as compared to the controls rather than interaction from the lithium salts in the underlayer.

TABLE XXI

| Sample | Dmin | Dmax | Speed-2 | ΔDmin |
|---|---|---|---|---|
| 7-1-C | 0.285 | 2.503 | 5.610 | +0.050 |
| 7-2 | 0.303 | 2.354 | 5.449 | +0.016 |
| 7-3 | 0.293 | 2.561 | 5.499 | +0.015 |
| 7-4-C | 0.300 | 2.397 | 5.562 | +0.040 |
| 7-5 | 0.300 | 2.411 | 5.569 | −0.010 |
| 7-6-C | 0.292 | 2.667 | 5.631 | +0.030 |
| 7-7 | 0.318 | 2.674 | 5.565 | +0.012 |

The invention has been described in detail with particular reference to certain preferred embodiments thereof, but it will be understood that variations and modifications can be effected within the spirit and scope of the invention.

The invention claimed is:

1. A black-and-white aqueous-based thermally developable material comprising a support and having thereon at least one thermally developable imaging layer comprising a first hydrophilic polymer binder or a water-dispersible polymer latex binder and in reactive association a non-photosensitive source of reducible silver ions, and a reducing agent for the reducible silver ions, and having disposed on said support between said support and said thermally developable imaging layer, a non-imaging conductive underlayer comprising one or more second hydrophilic polymers, a conductive metal oxide, and a smectite clay, said thermally developable material further comprising a lithium salt of a perfluorinated sulfonyl imide or an inorganic lithium salt.

2. The material of claim 1 wherein said conductive metal oxide can be represented by the following Structure I or II:

$$M^{+2}Sb^{+5}{}_2O_6 \quad (I)$$

wherein M is zinc, nickel, magnesium, iron, copper, manganese, or cobalt, $$M_a{}^{+3}Sb^{+5}O_4 \quad (II)$$

wherein $M_a$ is indium, aluminum, scandium, chromium, iron, or gallium.

3. The material of claim 1 wherein said first and second hydrophilic polymers are independently gelatin or a gelatin derivative, poly(vinyl alcohol), or a cellulosic polymer.

4. The material of claim 1 wherein said conductive metal oxide is present in said conductive underlayer as particles of clusters in an amount such that the weight ratio of said one or more second hydrophilic polymers to said conductive metal oxide is from about 1:1 to about 1:5.

5. The material of claim 1 wherein the conductive metal oxide is present in said conductive underlayer in an amount of from about 0.05 to about 1.0 g/m$^2$.

6. The material of claim 1 wherein said smectite clay is a natural montmorillonite clay.

7. The material of claim 1 wherein said smectite clay is present in said conductive underlayer in an amount of about 2 to about 12 g/m$^2$ and the weight ratio of said conductive metal particles to said smectite clay is from about 10:1 to about 150:1.

8. The material of claim 1 that is a photothermographic material further comprising a photosensitive silver halide.

9. The material of claim 1 wherein the non-photosensitive source of reducible silver comprises a silver salt of a nitrogen-containing compound comprising an imine or a silver salt of a fatty carboxylic acid.

10. The material of claim 1 wherein said reducing agent is a derivative of ascorbic acid.

11. The material of claim 1 wherein all layers are coated out of an aqueous solvent.

12. A black-and-white photothermographic material comprising a support having on a frontside thereof, a) one or more frontside photothermographic imaging layers comprising a hydrophilic polymer binder or a water-dispersible polymer latex binder, and in reactive association, a preformed photosensitive silver halide, a non-photosensitive source of reducible silver ions that is predominantly a silver salt of a nitrogen-containing heterocyclic compound containing an imino group, and a reducing agent for said non-photosensitive source reducible silver ions, b) said material comprising on the backside of said support, one or more backside photothermographic imaging layers having the same or different composition as said photothermographic imaging layers, and c) optionally, an outermost protective layer disposed over said one or more photothermographic imaging layers on either or both sides of said support, said material also comprising on both sides of said support, the same or different non-photosensitive conductive underlayer disposed between said support and said photothermographic layers, said same or different non-photosensitive conductive underlayer comprising a conductive metal oxide dispersed within a second hydrophilic polymer binder or water-dispersible polymer latex, said conductive metal particles comprising particles or clusters of non-acicular zinc antimonate, said photothermographic material further comprising a lithium salt of a perfluorinated sulfonyl imide or an inorganic lithium salt.

13. The material of claim 12 wherein the weight ratio of said conductive metal particles and said second hydrophilic polymer binder or water-dispersible polymer latex is from about 1:1 to about 1:5.

14. The material of claim 12 wherein said same or different non-photosensitive conductive underlayers further comprise a smectite clay such that the weight ratio of said conductive metal particles to said smectite clay is from about 10:1 to about 150:1.

15. The material of claim 12 that is spectrally sensitized to a wavelength of from about 350 to about 850 nm.

16. The material of claim 1 wherein the lithium salt of a perfluorinated sulfonyl imide or an inorganic lithium salt is present in an amount of from about 0.0001 to about 0.01 $mol/m^2$.

17. A method of forming a visible image comprising:

(A) imagewise exposing the thermally developable material of claim 1 that is a photothermographic material to form a latent image, (B) simultaneously or sequentially, heating said exposed photothermographic material to develop said latent image into a visible image.

18. The method of claim 17 wherein said photothermographic material is arranged in association with one or more phosphor intensifying screens during imaging.

19. The method of claim 17 further comprising using said exposed photothermographic material for medical diagnosis.

20. An imaging assembly comprising the thermally developable material of claim 1 that is a photothermographic material and that is arranged in association with one or more phosphor intensifying screens.

21. The imaging assembly of claim 20 wherein said photothermographic material comprises a photosensitive silver halide that is spectrally sensitive to a wavelength of from about 300 to about 450 nm, and said phosphor intensifying screens are capable of emitting radiation in the range of from about 300 to about 450 nm.

* * * * *